US005904294A

United States Patent [19]

Knobbe et al.

[11] Patent Number: 5,904,294

[45] Date of Patent: May 18, 1999

[54] PARTICLE SPRAY APPARATUS AND METHOD

[75] Inventors: Alan J. Knobbe, Amherst; Terrence M. Fulkerson, Parma, both of Ohio

[73] Assignee: Nordson Corporation, Westlake, Ohio

[21] Appl. No.: 08/710,189

[22] Filed: Sep. 13, 1996

[51] Int. Cl.[6] ..... B05B 5/03

[52] U.S. Cl. ..... 239/3; 239/8; 239/105; 239/706

[58] Field of Search ..... 239/704–708, 239/690, 520–524, 518, 3, 8

[56] References Cited

U.S. PATENT DOCUMENTS

| | | | |
|---|---|---|---|
| 1,296,542 | 3/1919 | McConnell | 239/520 X |
| 3,029,030 | 4/1962 | Dey | 239/520 |
| 3,591,091 | 7/1971 | Galloway | 259/524 X |
| 3,964,683 | 6/1976 | Gimple . | |
| 4,106,697 | 8/1978 | Sickles et al. . | |
| 4,228,961 | 10/1980 | Itoh . | |
| 4,462,061 | 7/1984 | Mommsen . | |
| 4,634,058 | 1/1987 | Hollsfein et al. | 239/707 X |
| 4,638,951 | 1/1987 | Gabriel . | |
| 4,784,331 | 11/1988 | Sharpless et al. | 239/707 X |
| 4,815,666 | 3/1989 | Gacka et al. | 239/706 |
| 4,819,879 | 4/1989 | Sharpless et al. . | |
| 4,987,001 | 1/1991 | Knobbe et al. . | |
| 5,056,720 | 10/1991 | Crum et al. . | |
| 5,582,347 | 12/1996 | Knobbe et al. | 239/707 X |

FOREIGN PATENT DOCUMENTS

| | | | |
|---|---|---|---|
| 462680 | 9/1968 | Germany | 239/706 |
| 2509851 | 9/1976 | Germany . | |
| 21 92 351 | 1/1988 | United Kingdom . | |

*Primary Examiner*—Kevin Weldon
*Attorney, Agent, or Firm*—Galfee, Halter & Griswold, LLP

[57] ABSTRACT

An apparatus for use in directing a flow of air with particles entrained therein toward a workpiece includes a nozzle and a deflector. The nozzle has a passage with a noncircular cross sectional configuration. The deflector has an outer side surface with a circular cross sectional configuration. A flow of air with particles of powder entrained therein is conducted along outer surface areas on the deflector at a first volumetric flow rate. A flow of air with particles of powder entrained therein is conducted along outer surface areas on the deflector at a second volumetric flow rate which is greater than the first flow rate. The deflector includes a porous member which is releasably connected with a main portion of the deflector to facilitate cleaning and provide access to the interior of the deflector. Seal members are provided between an electrode sheet, the porous member, and the main portion of the deflector.

35 Claims, 9 Drawing Sheets

PARTICLE SPRAY APPARATUS AND METHOD

BACKGROUND OF THE INVENTION

An improved particle spray apparatus and method is used to electrostatically charge particles entrained in a flow of air and to direct the flow of air and particles toward a workpiece.

A known apparatus for directing a flow of air with electrostatically charged particles entrained therein toward a workpiece is disclosed in U.S. Pat. No. 4,819,879. This apparatus includes a spray gun having a central passage along which a flow of air with particles entrained therein is conducted. The flow of air with particles entrained therein is radially expanded by engagement with a conical deflector.

The apparatus disclosed in the aforementioned U.S. patent includes an electrical apparatus which electrostatically charges the particles entrained in the flow of air. The electrical apparatus includes various electrode arrangements which are exposed to the flow of air and particles around an axially outer end portion of the deflector. The electrode arrangement may include a silicon carbide electrode sheet which is mounted on the axially outer end portion of the deflector.

Another known particle spray gun is disclosed in U.S. Pat. No. 3,964,683. The particle spray gun disclosed in this patent includes a nozzle in which an electrode support member is mounted. A needle-shaped charging electrode is disposed in a passage which extends through the support member. Air is conducted to the passage in which the electrode is disposed to blow powder off of the electrode. The air is conducted through a passage in a radially extending spoke or strut which supports the support member in the nozzle.

SUMMARY OF THE INVENTION

The present invention provides a new and improved apparatus and method for use in directing a flow of air with particles entrained therein toward a workpiece. An electrode arrangement is provided in the apparatus to electrostatically charge particles entrained in the flow of air. The electrode arrangement may be exposed to a flow of air to remove contaminants which may tend to form around the electrode arrangement.

In order to increase the area on a workpiece which can be covered with particles in a single pass between the workpiece and a spray apparatus, the spray apparatus includes a nozzle having a passage with a noncircular cross sectional configuration. A flow of air with particles entrained therein is conducted through the noncircular passage in the nozzle and engages an outer side surface of a deflector. The outer side surface of the deflector has a circular cross sectional configuration.

Due to the noncircular cross sectional configuration of the passage through the nozzle, the powder is conducted at different volumetric flow rates along different surface areas on the deflector. The surface areas on the deflector along which particles are conducted at a relatively high volumetric flow rate causes the particles to flow relatively large distances away from a central axis of the deflector. The surface areas on the deflector along which particles are conducted at a relatively low volumetric flow rate cause the particles to flow relatively small distances away from the central axis of the deflector. The particles are applied to a surface of a workpiece in a pattern which is relatively large along one axis and relatively small in another direction. Therefore, relative movement between the workpiece and the deflector may result in the application of a relatively wide strip of particles to the workpiece.

The deflector may advantageously include a porous member which is releasably connected with a main portion of the deflector by a plurality of fasteners. One or more seal members may be provided to engage the electrode sheet at a location between the porous member and the main portion of the deflector. The porous member is releasably connected with the main portion of the deflector to facilitate cleaning and provide access to the interior of the deflector.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
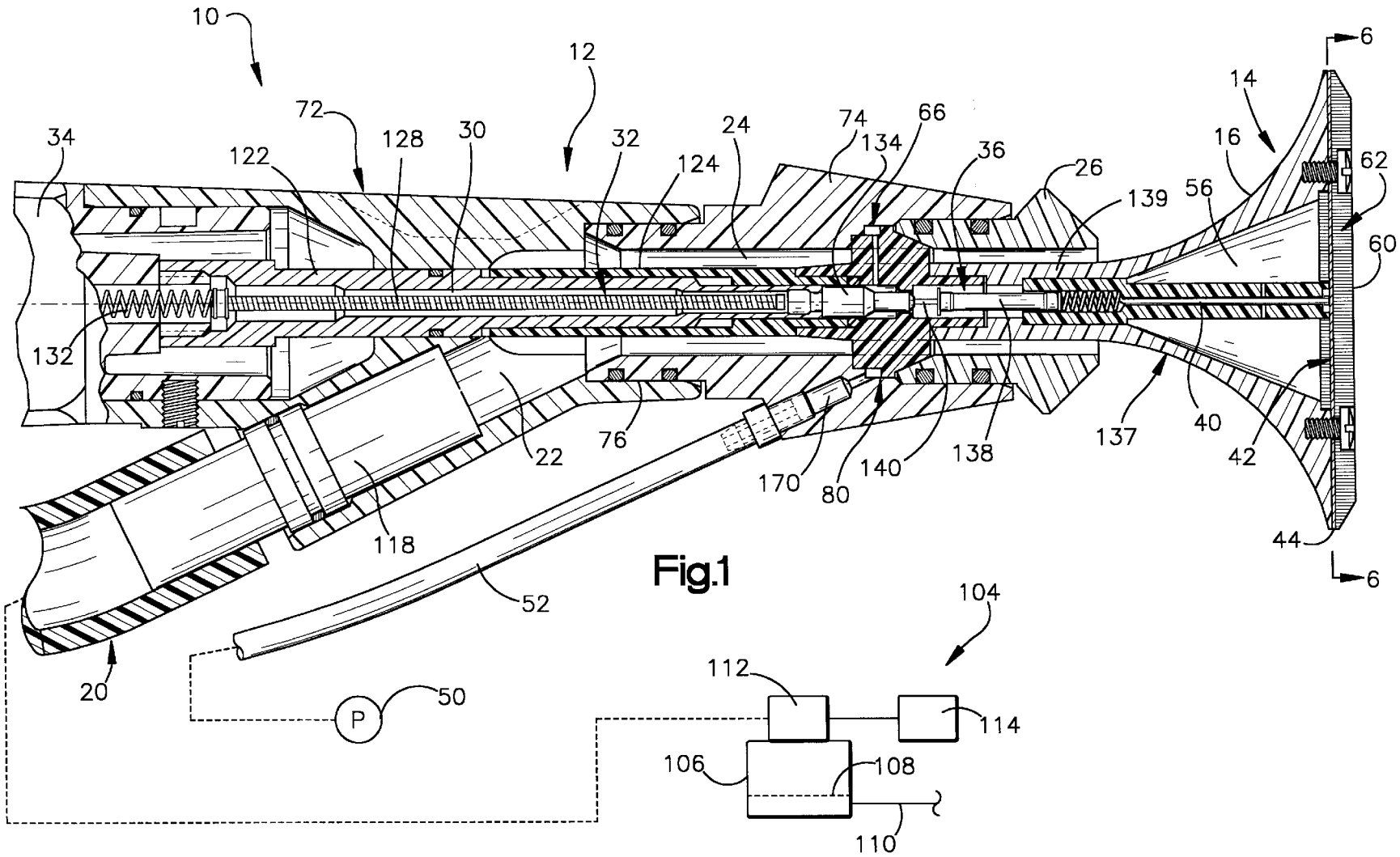
FIG. 1 is a fragmentary sectional view illustrating an apparatus which directs a flow of air with particles entrained therein toward a workpiece.

An apparatus or spray gun 10 for use in directing a flow of air with particles entrained therein toward a workpiece (not shown) is illustrated in FIG. 1. The spray gun 10 includes a housing assembly 12 through which a flow of air with particles entrained therein is conducted. A conical deflector 14 is connected with the housing assembly 12. The flow of air with particles entrained therein flows along a generally conical outer side surface 16 of the deflector 14 to expand the flow of air with particles entrained therein.

The flow of air with particles of powder entrained therein is conducted to the housing assembly 12 (FIG. 1) through a delivery conduit 20. The flow of air with particles of powder entrained therein is conducted from the delivery conduit 20 through an inlet passage 22 to an outer central passage 24 disposed in the housing assembly 12. The outer central passage 24 extends through a nozzle 26 adjacent to the base of the deflector 14. The nozzle 26 directs the flow of air with powder particles entrained therein toward the deflector 14.

An inner central passage 30 in the housing assembly 12 is coaxial with and is circumscribed by the outer central passage 24. An electrical apparatus 32 is disposed within the inner central passage 30 and extends from a voltage multiplier 34 through the housing assembly 12 into the deflector 14. The electrical apparatus 32 includes a voltage multiplier 34 and an electrode arrangement 36. The voltage multiplier 34 supplies a relatively high voltage, in the illustrated embodiment of the invention, about 100,000 volts, to the electrode arrangement 36.

The electrode arrangement 36 (FIG. 1) electrostatically charges particles of powder entrained in the flow of air discharged from the spray gun 10 toward the workpiece. The electrode arrangement 36 includes an electrode rod 40 which is disposed in the portion of the inner central passage 30 located in the deflector 14 and an electrode sheet 42 which is located in an axially outer end portion of the deflector 14. A peripheral edge portion 44 of the electrode sheet 42 is disposed in an axially and radially outer end portion of the deflector 14 and is exposed to the flow of air with particles of powder entrained therein. The relatively high voltage conducted to the electrode sheet 42 through the electrode rod 40 is effective to electrostatically charge the particles entrained in the flow of air as the particles move past the outer end portion of the deflector 14.

At least a portion of the electrode arrangement 36 is exposed to a flow of fluid (air) to remove any contaminants which may accumulate around the electrode arrangement. The flow of air is conducted from a regulated compressed air supply 50 through a fluid supply conduit 52 to the inner central passage 30. The flow of air is conducted along the electrical apparatus, in the part of the inner central passage 30 which is forward of element 134 (later described) to a generally conical chamber 56 in the deflector 14 through passages 192, 194 (FIG. 4) later described.

The electrode rod 40 and other components of the electrical apparatus 32 are disposed in the inner central passage 30. Therefore, the flow of air in the inner central passage 30 forward of element 134 washes away or removes any contaminants which may accumulate adjacent to the electrode rod 40 and/or other components of the electrical apparatus 32 which are forward of element 134. The contaminants may be the result of an interaction between components of the housing assembly 12 and/or deflector 14 and the electrical apparatus 32 due to the high voltage in the electrical apparatus.

During operation of the spray gun 10, powder particles may tend to accumulate on a front surface 60 of the deflector 14. The accumulation of particles on the circular front surface 60 of the deflector 14 is retarded by an air flow from the chamber 56 in the deflector. The air flows from the chamber 56 through the porous electrode sheet 42 and through a porous member 62 which comprises the front surface 60 of the deflector 14. The porous member 62 forms a circular front wall of the deflector 14.

During operation of the spray gun 10, the high voltage conducted through the electrical apparatus 32 may cause an arc to form in a passage system 66 (FIG. 1) which connects the air supply conduit 52 with the inner central passage 30. This could occur, for example, if an external ground were positioned where conduit 52 connects to the member 74 (later described) of gun 10. The passage system 66 from the end of the fluid supply conduit 52 to the electrical apparatus 32 within inner central passage 30 is made relatively long and circuitous to prevent the formation of an arc in the passage 66. Thus, the passage system 66 extends at least half way around the outer central passage 24 before being connected with the inner central passage 32. The resulting substantial length and changes in direction of the passage system 66 prevents the formation of an arc to an external ground since the arc would have to travel through the passage system 66 from the electrical apparatus 32 to a ground outside of the housing assembly 12.

Housing Assembly

The housing assembly 12 includes a main housing section 72 (FIG. 1). The voltage multiplier 34 is connected with the main housing section 72. A nozzle extension 74 is also connected with the main housing section 72. The nozzle extension 74 is received in a cylindrical recess 76 formed in the main housing section 72.

A one-piece support structure or spider 80 (FIGS. 1 and 2) is disposed in the nozzle extension 74. The outer central passage 24 extends through arcuate openings 82 and 84 (FIG. 3) formed in the spider 80. The inner central passage 30 extends through a cylindrical central opening 86 formed in the spider 80. The opening 86 is formed in a generally cylindrical central portion 88 of the spider 80. The central portion 88 of the spider 80 is supported by upper and lower struts 92 and 94 which extend between the central portion of the spider and a circular outer ring portion 96 of the spider.

The nozzle 26 (FIG. 2) is received in a cylindrical recess 100 formed in an axially outer end portion of the nozzle extension 74. The main housing section 72 (FIG. 1), nozzle extension 74, spider 80 and nozzle 26 are formed of suitable polymeric material which is electrically insulating. Therefore, the main housing section 72, nozzle extension 74, spider 80 and nozzle 26 are effective to insulate the electrical apparatus 32 from any object in the environment surrounding the spray gun 10 which may be grounded.

During operation of the spray gun 10, a control apparatus 104 (FIG. 1) controls the flow of air with powder entrained therein through the delivery conduit 20 to the spray gun 10. The control apparatus 104 includes a fluidizing bed powder container or hopper 106 which contains powder. A bottom fluidizing bed plate 108 of porous material is disposed in the hopper 106. Fluidizing air is conducted through a conduit 110 to the hopper 106.

The fluidizing air conducted through the conduit 110 through the hopper 106 is directed upward through the fluidizing bed bottom plate 108 into the upper portion of the hopper 106. The flow of fluidizing air through the plate 108 fluidizes the powder in the upper portion of the hopper 106 in a known manner. If desired, a mechanical agitator may be provided in the upper portion of the hopper 106 to promote fluidization of the powder.

The fluidized powder is conducted from the hopper 106 through a venturi pump 112. Operation of the venturi pump 112 is controlled by a gun control module 114 which determines the timing and press 112 to air supplied to pump 112 to achieve the desired powder flow to the gun.

The flow of air with powder entrained therein from the venturi pump 112 is conducted through the delivery conduit 20 and a connector fitting 118 to the inlet passage 22 in the main housing section 72 (FIG. 1). The flow of air with powder entrained therein is conducted from the inlet passage 22 into the outer central passage 24. The outer central passage 24 has a tubular cylindrical configuration and extends from the main housing section 72 through the nozzle extension 74, the openings 82 and 84 (FIG. 3) in the spider 80, and through the nozzle 26 (FIG. 1) toward the deflector 14. The outer central passage 24 has an annular cross sectional configuration except when passing through openings 82, 84. Therefore, the flow of air with powder particles entrained therein from the nozzle 26 has an annular cross sectional configuration. The deflector 14 expands the annular flow of air with powder entrained therein from the nozzle 26 radially to form a generally conical spray pattern which covers a substantially greater area than the annular cross sectional configuration of the flow of air with powder entrained therein from the nozzle 26.

Electrical Apparatus

The electrical apparatus 32 is disposed in the inner central passage 30. The inner central passage 30 (FIG. 1) is disposed in a coaxial relationship with and is partially surrounded by the cylindrical tubular outer central passage 24.

The electrical apparatus 32 extends from the voltage multiplier 34 through the inner central passage 30 to an axially outer end portion of the deflector 14. The outer central passage 24 extends along the inner central passage 30 from the main housing section 72 through the nozzle extension 74, spider 80, and nozzle 26. However, unlike the outer central passage 24, the inner central passage 30 extends into the deflector 14 and is connected in fluid communication with the chamber 56 in the deflector.

The left side of passage 30 (in FIG. 1) is formed by the hollow interior diameter of cylindrical probe-or casing 122 which is connected to the housing encasing voltage multiplier 34. The probe 122 is supported by the main section 72 of the housing assembly 12. A generally cylindrical wear sleeve 124 encloses a portion of the probe 122. The cylindrical wear sleeve 124 encases the right end of probe 122 in FIG. 1. Wear sleeve 124 is exposed to the flow of air with powder entrained therein conducted from powder inlet 22 through the outer central passage 24.

Wear sleeve 124 is formed of a material which is resistant to abrasion by the powder particles. If wear sleeve 124 becomes abraded after extended use of the spray gun 10, the wear sleeve can be readily replaced. Wear sleeve 124 and probe 122 are supported by and enclosed within a cylindrical portion of spider 80 which extends to the left in FIG. 1.

The electrical apparatus 32 includes a cylindrical resistor stack 128 (FIG. 1) which is located in the portion of the central passage 30 disposed in the probe 122. The resistor stack 128 is connected with the voltage multiplier 34 through a spring 132. Thus, the relatively high output voltage (100 kv) from the voltage multiplier 34 is conducted through the spring 132 to the resistor stack 128. The right end of the resistor stack 128 in FIG. 1 is in electrical contact with a wire 140 which passes through a tip 134, which in turn extends from probe 122 through central opening 86 (FIG. 3) in spider 80. Tip 134 is constructed from a non-conductive material and is connected to the right most end of probe 122 in FIG. 1.

The open space in the portion of the inner central passage 30 which extends along the resistor stack 128 is filled with dielectric grease which provides electrical insulation around the resistor stack 128. A grease tight seal is formed between the tip 134 and the probe 122. The hole provided in tip 134 for accepting wire 140 is slightly smaller than wire 140 to provide a friction fit and prevent grease from entering tip 134. Open space is provided between outer side surfaces of the electrical apparatus 32 and the inner side surfaces of the inner central passage disposed to the right (as viewed in FIG. 1) of the tip 134 to enable air to flow along this portion of the inner central passage. An O-ring 300 centers tip 134 in the passage 32 through spider 80 and prevents air from flowing back past tip 134.

In addition to the resistor stack 128, the electrical apparatus 32 includes a second resistor 138 (FIG. 4) which is disposed in a portion of the central passage 30 which extends into the deflector 14. The deflector 14 has a hollow rigid housing 137 (FIG. 4) formed of a suitable polymeric material which is electrically insulating. The resistor 138 is disposed in a cylindrical stem portion 139 of the deflector housing 137 and is electrically connected with the resistor stack 128 by pin 140 which passes through tip 134 to a contact washer 142. Contact washer 142 makes electrical contact with resistor 138.

Figure 4:
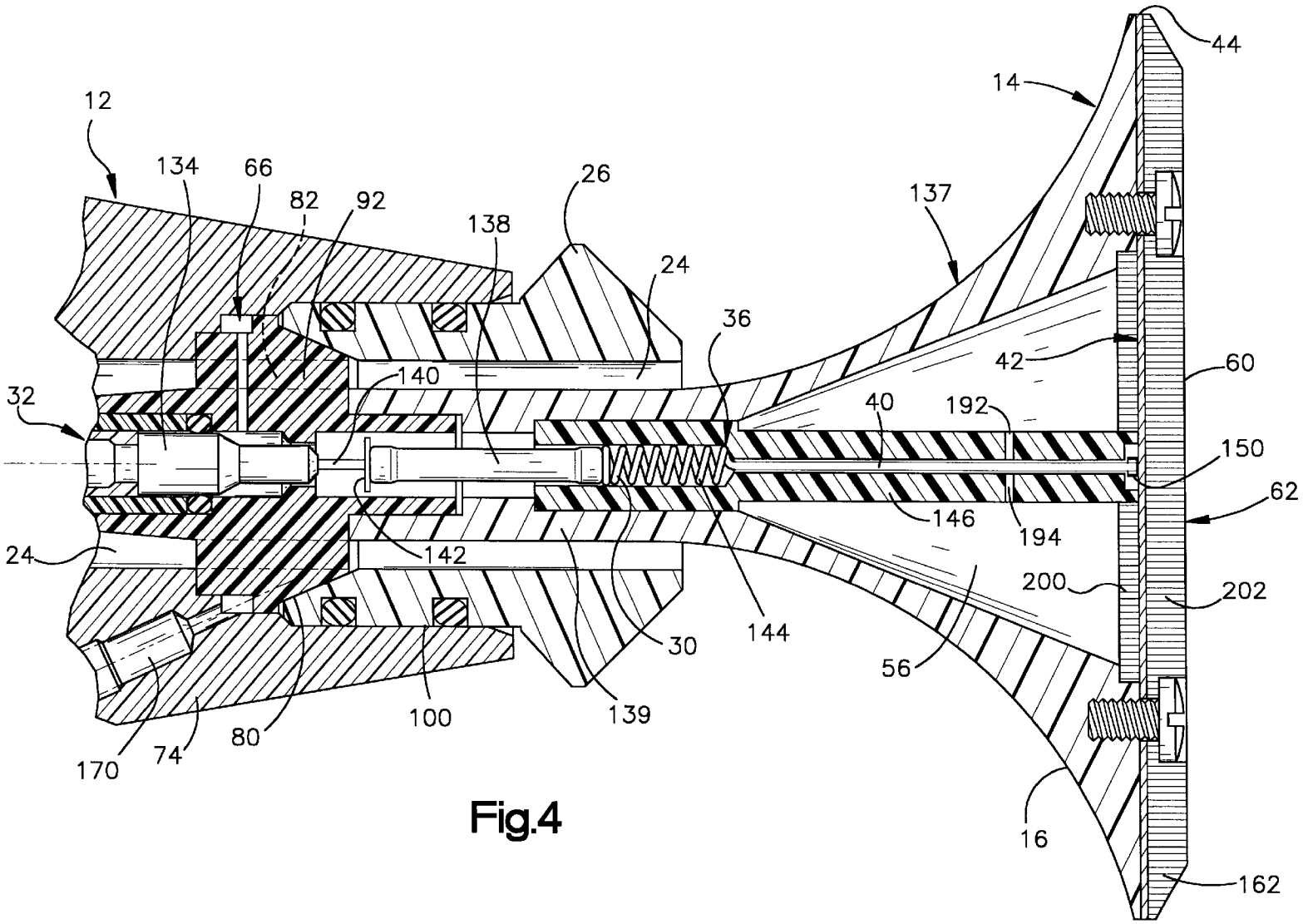
FIG. 4 is an enlarged fragmentary sectional view of a portion of FIG. 1 and illustrating the relationship of a deflector to the inner and outer central passages and to the electrical apparatus.

A spring 144 contacts the right end of resistor 138 in FIG. 4 and includes a right end which is formed as a straight electrode 40. Electrode 40 extends along a portion of the inner central passage 30 which is disposed in a cylindrical support 146.

Cylindrical support 146 extends axially through the conical chamber 56 and has a central axis which is coincident with the central axis of the chamber. The left (as viewed in FIG. 4) end of the support 146 is coaxial with and is supported by the stem portion 139 of the deflector 14. The support 146 is formed of a suitable polymeric material which is electrically insulating.

Figure 5:
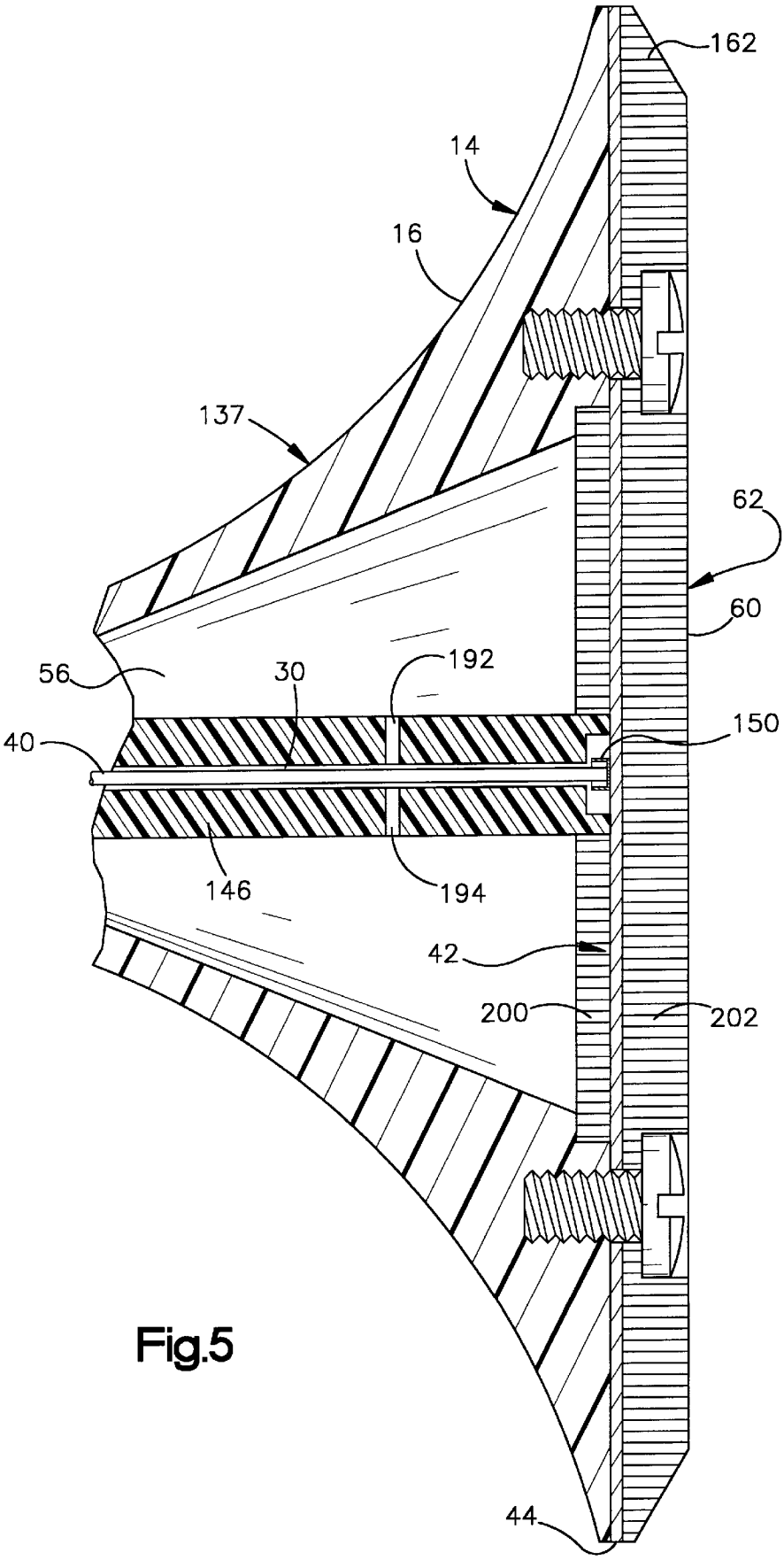
FIG. 5 is an enlarged fragmentary sectional view of a portion of FIG. 4 and illustrating the relationship of the deflector to an electrode arrangement which electrostatically charges particles entrained in the flow of air.

A cup-shaped metal eyelet or contact 150 (FIG. 5) connects the right end of electrode 40 as shown in FIG. 5 with the electrode sheet 42. Since the left end of electrode 40 is formed as a spring, eyelet 150 is spring biased into contact with sheet 42. Voltage is conducted from the voltage multiplier 34 (FIG. 1) through the resistor 128, pin 140, washer 142, resistor 138, electrode 40, and metal eyelet 150 to the electrode sheet 42.

Figure 6:
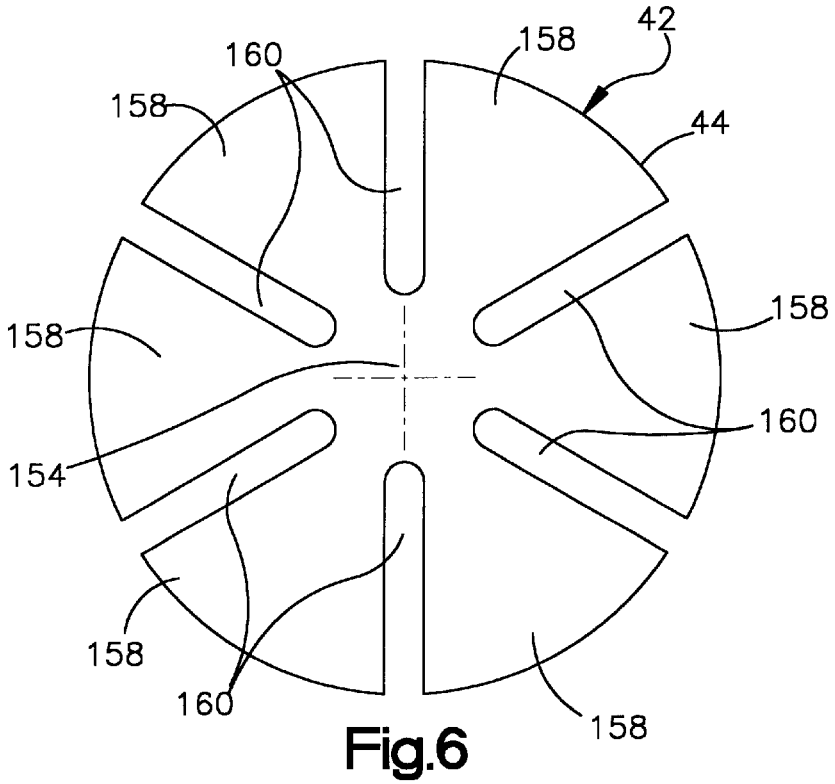
FIG. 6 (on sheet 3 of the drawings) is a plan view, taken generally along the line 6—6 of FIG. 1, of an electrode sheet used in the electrode arrangement of FIG. 5.

The electrode sheet 42 has a circular configuration (FIG. 6). The cup-shaped eyelet 150 (FIG. 5) abuts a central portion 154 (FIG. 6) of the electrode sheet 42. The electrode 40 (FIG. 5) has a longitudinal central axis which extends perpendicular to the electrode sheet 42. The electrode sheet 42 has a major side surface which extends parallel to the front surface 60 of the deflector 14.

The electrode sheet 42 (FIG. 6) is formed into a plurality of generally pie-shaped arcuate segments 158 by a plurality of slots 160 which extend radially outwardly from the central portion 154 of the electrode sheet. The peripheral edge portion 44 of the electrode sheet 42 is divided into a plurality of arcuate sections by the slots 160. The electrode sheet 42 may be a porous non-woven fabric formed of fibers which are electrically resistive such as the silicon carbide material disclosed in U.S. Pat. No. 4,819,879 which is hereby incorporated by reference in its entirety. Electrical energy is conducted from the electrode 40 and eyelet 150 to the central portion 154 of electrode sheet 42. This electrical energy is conducted through the electrode sheet 42 to the peripheral edge portion 44 of the electrode sheet.

The peripheral edge portion 44 of the electrode sheet 42 is exposed at the circumference 162 of the deflector 14 (FIG. 5). Particles of powder entrained in the flow of air which is conducted along the deflector 14 are electrostatically charged by the electrode sheet 42 in a manner described in U.S. Pat. No. 4,819,879. Briefly, a corona discharge is produced at the ends of the fibers which are exposed at the peripheral edge portion 44 of the electrode sheet 42. This corona discharge causes an electrostatic charge to be imparted to particles of powder which flow past the peripheral edge portion 44 of the electrode sheet 42.

In the specific embodiment of the invention illustrated in FIGS. 5 and 6, the electrode sheet 42 is formed of silicon carbide fibers which form a porous non-woven fabric. This non-woven silicon carbide fiber fabric is commercially available from Dow Corning Corporation of Midland, Mich. under the trademark NICALON and has the characteristics set forth in the previously mentioned U.S. Pat. No. 4,819,879. Of course, the porous electrode sheet 42 could be formed of a different electrically resistive material if desired.

Instead of the electrode sheet 42, any one of many different electrode arrangements could be utilized to electrostatically charge the powder particles as they flow past the radially and axially outer end portions of the deflector 14. Thus, a circular array of electrode elements could extend radially outwardly from the end of the electrode rod 40 to the axially and radially outer end portion of the deflector 14. The radially outer ends of the electrode elements could be exposed to the flow of air with particle elements entrained therein to enable the particles to be electrostatically charged. If desired, resistors could be provided in association with the electrode elements. Alternatively, an annular silicon carbide thread, ribbon or band could be disposed at the radially and axially outer end portion of the deflector 14 and electrically connected with the electrode 40 in the manner disclosed in the aforementioned U.S. Pat. No. 4,819,879.

Air Supply

A flow of air is conducted along the right side of central passage 30 (FIGS. 1 and 4) to remove any contaminants which may collect adjacent to components of the electrode arrangement 36. The flow of air is conducted from the spider 80 through the central passage 30 into the chamber 56 in the deflector 14. To prevent the accumulation of powder particles on the front surface 60 of the deflector 14 and to remove contaminants which may accumulate adjacent to the electrode sheet 42, a flow of air is conducted from the chamber 56 through the porous electrode sheet 42 and porous member 62 of deflector 14. If separate electrode elements, such as wires which extend radially outward from the electrode rod 40, are utilized instead of the electrode sheet 42, the flow of air would remove any contaminants which may accumulate adjacent to the electrode elements.

Figure 2:
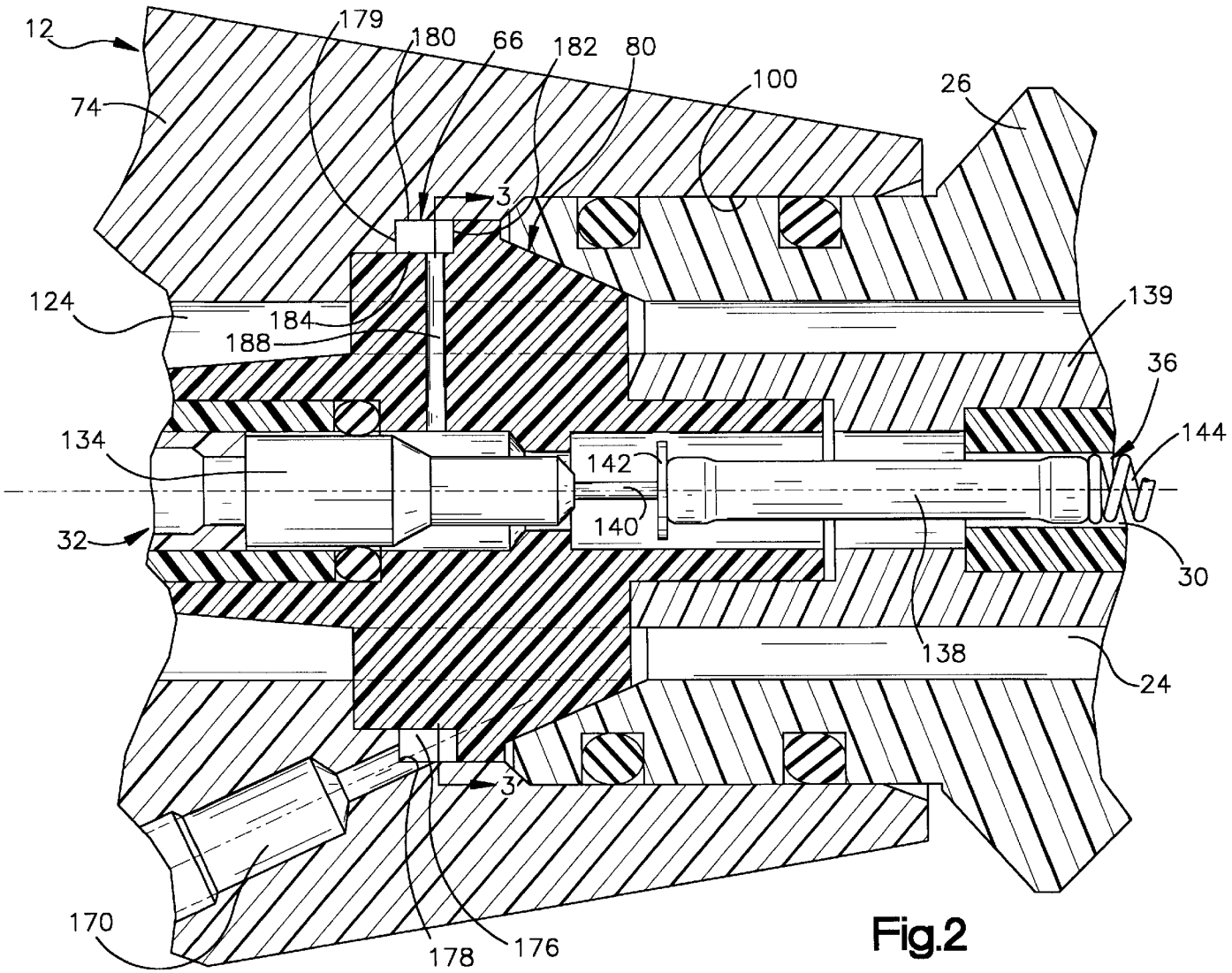
FIG. 2 is an enlarged fragmentary sectional view of a portion of FIG. 1 and illustrating the relationship between an inner central passage which contains electrical apparatus and an outer central passage which extends around the inner central passage and conducts the flow of air with particles entrained therein.
Figure 3:
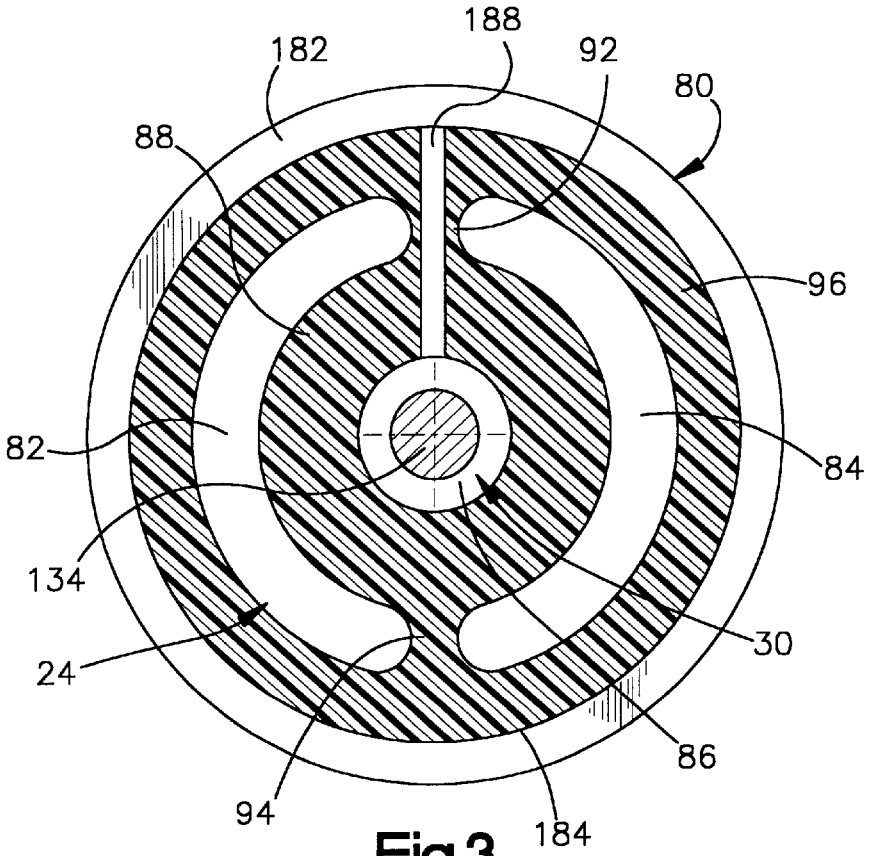
FIG. 3 is a sectional view, taken generally along the line 3—3 of FIG. 2, illustrating the construction of a support structure through which the inner and outer central passages extend.

The fluid supply conduit 52 (FIG. 1) is connected with an inlet passage 170 (FIGS. 1 and 4) formed in the nozzle extension 74. The inlet passage 170 is connected with the inner central passage 30 through the relatively long and circuitous passage system 66 (FIG. 2).

The passage system 66 (FIG. 2) includes an annular intermediate passage 176 which is connected with the inlet passage 170 at a location 178 disposed radially outwardly from the outer central passage 24. The annular intermediate passage 176 extends around and is coaxial with the outer central passage 24 and the inner central passage 30. The annular intermediate passage 176 is formed between the inner side surfaces on the nozzle extension 74 and outer side surfaces on the spider 80. Thus, a flat annular side surface 179 and a cylindrical side surface 180 on the nozzle extension 74 cooperate with a flat annular shoulder surface 182 and a cylindrical surface 184 formed on the spider 80 (FIG. 2) to form the annular intermediate passage 176.

A radially extending connector passage 188 is formed in the spider 80 and extends through the upper strut 92 (FIG. 3) to the inner central passage 30. The radially extending connector passage 188 (FIG. 2) is connected with the annular intermediate passage 176 at a location which is diametrically opposite from the location 178 where the inlet passage 170 is connected with the annular intermediate passage. Therefore, air must flow half way around the cylindrical outer side surface 184 on the spider 80 before entering the passage 188.

An electrical arc or spark which is to extend from the electrical apparatus 32 through the passage system 66 will have to extend along the connector passage 188 to the annular intermediate passage 176. The electrical arc would then have to extend along one half (180°) of the length of the annular intermediate passage 176 before entering the inlet passage 170 and finally arriving at an external ground positioned adjacent to the end of conduit 52. This relatively long and circuitous distance prevents an arc to be established in the passage system 66 between the electrical apparatus 32 and an external ground adjacent to the air inlet passage 170.

Once the air has been conducted from the fluid supply conduit 52 through the passage system 66 to the inner central passage 30, the fluid flows along the components of the electrical apparatus 32. Thus, the air flows axially along the exterior of tip 134 (FIG. 2) and along the second resistor 138 (FIG. 2) into the portion of the inner central passage 30 disposed in the support member 146 (FIG. 4). The air then flows from the portion of the inner central passage 30 in the support member 146 through passages 192 and 194 (FIG. 5) into the chamber 56.

From the chamber 56, the fluid flows through the porous member 62 and the fibrous electrode sheet 42 to the atmosphere around the deflector 14. In the illustrated embodiment of the invention, the porous member 62 forms the front wall of the deflector 14. In this specific embodiment, the porous member 62 is formed by a porous rigid circular rear plate 200 and a porous rigid circular front plate 202. The fibrous electrode sheet 42 is disposed between the front and rear plates 200 and 202. The right (as viewed in FIG. 5) end of the support member 146 is supported in an opening in the rear plate 200.

The front and rear plates 200 and 202 are formed of a an electrically insulating porous material. The electrode sheet 42 is formed of a porous material, that is a non-woven silicon carbide fabric. Therefore, air pressure in the chamber 56 can induce a flow of air from the chamber through the porous rear plate 200, electrode sheet 42 and front plate 202. The flow of fluid through the front plate 202 is effective to prevent the accumulation of particles of powder on the circular front surface 60 of the deflector 14.

In the embodiment of the invention illustrated in FIGS. 4 and 5, the porous rear plate 200 and porous front plate 202 are formed of high density polyethylene which is commercially available from Porex Technologies having a place of business at 500 Bohannon Road, Fairburn, Ga.

It is contemplated that the porous member 62 in the deflector 14 may be formed with only a single porous plate, that is the front plate 202. The rear plate 200 may be eliminated. If this is done, the electrode sheet 42 may be secured to the porous front plate 202 with adhesive or other fasteners.

It is also contemplated that the porous front plate 202 may be formed of an electrically insulating material other than high density polyethylene. For example, the porous front plate and/or the porous rear plate 200 may be formed by a flat sheet of electrically insulating material in which holes have been formed by drilling or other mechanical processes. It is also contemplated that a relatively flexible mesh of electrically insulating material could be used to form the porous rear and/or front plates 200 and 202 if desired. If desired, a porous, electrically insulating material could be molded around electrode elements to form the porous screen 62 as one piece.

In the embodiment of the porous screen 62 illustrated in FIGS. 4 and 5, the entire rear and front plates 200 and 202 are formed of porous material. This is advantageous since it enables the flow of fluid from the chamber 56 to be conducted through the entire end surface of the chamber. However, if desired, a portion of the rear plate 200 and/or front plate 202 could be nonporous.

Operation

When the spray gun 10 is to be operated, the spray gun may be mounted on a fixture or other support structure. The delivery conduit 20 (FIG. 1) is connected with the venturi pump 112 in the control apparatus 104 and the air supply conduit 52 is connected with the regulated compressed air supply 50. A grounded workpiece (not shown) is positioned in front of the spray gun 10.

Upon actuation of the gun control module 114, air with powder entrained therein is conducted from the hopper 106 through the pump 112 and delivery conduit 20 to the inlet passage 22 in the housing assembly 12 of the spray gun. The air with powder entrained therein is then conducted along the passage 24 toward the nozzle 26. The flow of air with powder entrained therein is then deflected radially outwardly by the outer side surface 16 of the deflector 14 to expand the cloud of powder coating material to have a relatively large, generally conical, spray pattern.

At the same time, air under pressure is conducted from the pump 50 through the fluid supply conduit 52 to the passage system 66. The flow of air in the passage system 66 is conducted half way around the annular intermediate passage 176 (FIG. 2) from the inlet 178 to the connector passage 188. The air then flows from the passage 188 into the inner central passage 30.

The air is conducted along the passage 30 to the chamber 56 in the deflector 14. As the air flows along the passage 30, it washes away or removes any contaminants which may form adjacent to the components of the electrical apparatus 32. The air then flows into the deflector chamber 56 through the passages 192 and 194 in the support member 146 which extends through the chamber 56.

The air pressure in the chamber 56 causes the air to flow through the inner porous plate 200, the fibrous electrode sheet 42 and the porous outer plate 202 out the front of the deflector 14. Since the front surface 60 on the porous member 62, which forms an end wall of the deflector 14, faces toward the workpiece, particles of powder would normally tend to accumulate on the front surface 60 of the porous member 62. However, the flow of air from the chamber 56 through the porous member 62 prevents powder from accumulating on the front surface 60 of the deflector 14. In addition, the flow of air through the porous screen 62 and the electrode sheet 42 washes away or removes any contaminants which may tend to accumulate adjacent to the electrode sheet.

During use of the spray gun 10, it is important to avoid the formation of an arc between the spray gun and a grounded member which is brought close to the spray gun. To prevent the formation of an arc extending from the electrical apparatus 32 through the passage system 66 (FIG. 2) to the inlet passage 170 for the fluid supply conduit 52, the passage system is relatively long and circuitous, as has been described above. The arc prevention feature of this invention is not limited to guns having conical deflectors but would also apply to guns having other spray nozzles such as flat spray nozzles.

Second Embodiment of the Invention

The air with powder particles entrained therein flows from the delivery conduit 20 (FIG. 1) through the inlet passage 22 into the passage 24. As this occurs, the powder particles tend to become concentrated adjacent in the upper (as viewed in FIG. 1) portion of the passage 24 opposite from the inlet passage 22 due to their momentum and the orientation of inlet 22. To reduce this concentration of powder in the upper part of passage 24, in the embodiment of the invention illustrated in FIG. 7, air is injected into the upper part of passage 24 to pressurize this area and discourage powder flow into it. Since the embodiment of the invention illustrated in FIG. 7 is generally similar to the embodiment of the invention illustrated in FIGS. 1–6, similar numerals will be utilized to designate similar components, the suffix letter "a" being associated with the numerals of FIG. 7 to avoid confusion.

Figure 7:
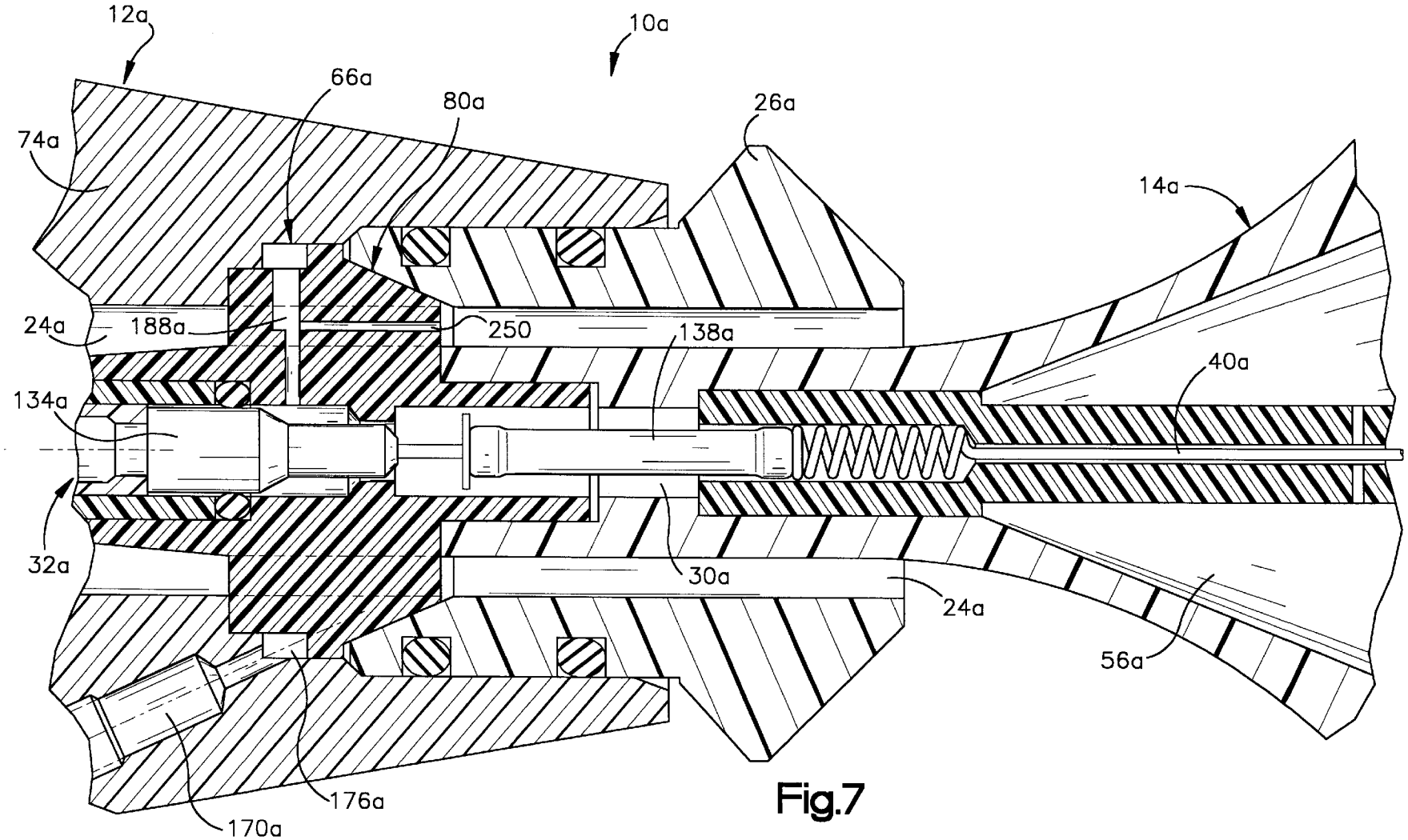
FIG. 7 is a fragmentary sectional view, generally similar to FIG. 2, of another embodiment of the apparatus of FIG. 1.

In the embodiment of the invention illustrated in FIG. 7, the powder spray gun 10*a* includes a housing assembly 12*a* having a nozzle extension 74*a* in which a nozzle 26*a* and spider 80*a* are received. A flow of air with powder entrained therein is conducted along an outer central passage 24*a*. An electrical apparatus 32*a* is disposed in an inner central passage 30*a*. A flow of air is conducted through a passage system 66*a* to inner central passage 30*a* and then to a chamber 56*a* in a deflector 14*a*.

In accordance with a feature of the embodiment of the invention illustrated in FIG. 7, the passage system 66*a* includes a air injection passage 250 which extends between the connector passage 188*a* and the outer central passage 24*a*. Air under pressure is conducted through the injection passage 250 into the flow of air with powder entrained therein which is flowing through the outer central passage 24*a*. The flow of air from the injection passage 250 increases air pressure in the upper part of passage 24 which forces more powder down into the lower part of passage 24 to promote more even distribution of the powder entrained in the flow of air conducted through the passage 24*a*. In addition, by sending the powder through the arcuate flow paths 82, 84 in spider 80, the powder streams along the top and bottom of flow path 24 are split by the struts 92, 94 and concentrated, and then remixed at the downstream end of spider 80 to better homogenize the powder prior to deflector 14.

In summary the present invention provides a new and improved apparatus 10 and method for use in directing a flow of air with particles entrained therein toward a workpiece. An electrode arrangement 36 is provided in the apparatus to electrostatically charge particles entrained in the flow of air. The electrode arrangement 36 is exposed to a flow of fluid air to remove any contaminants which may tend to form around the electrode arrangement. In order to discourage accumulation of particles on a surface 60 of a deflector 14, the surface of the deflector is porous and a flow of fluid is conducted through the porous surface.

One embodiment of the electrode arrangement includes a porous electrode sheet 42 which is disposed adjacent to a porous screen 62 which forms the porous surface 60 of the deflector 14. A flow of air is conducted from a chamber in the deflector 14 through the porous electrode sheet 42 and the porous member 62 to retard the accumulation of particles on an end surface 60 of the deflector. To prevent the formation of an arc in a passage 66 through which the air is conducted to the electrode arrangement 36, the passage 66 is relatively long and preferably extends at least half way around a passage 24 through which the flow of air with particles entrained therein is conducted through the apparatus 10.

Third Embodiment—General Description

In the embodiments of the invention illustrated in FIGS. 1–7, the nozzles 26 (FIG. 1) and 26*a* (FIG. 7) have cylindrical inner side surfaces which at least partially define the passages 24 and 24*a* extending through the nozzles. The passages 24 and 24*a* through the nozzles 26 and 26*a* have a circular cross sectional configuration and are disposed in a coaxial relationship with the generally conical outer side surfaces of the deflectors 14 and 14*a*. This results in a substantially uniform volumetric flow rate of particles along the outer side surfaces of the deflectors.

Figure 8:
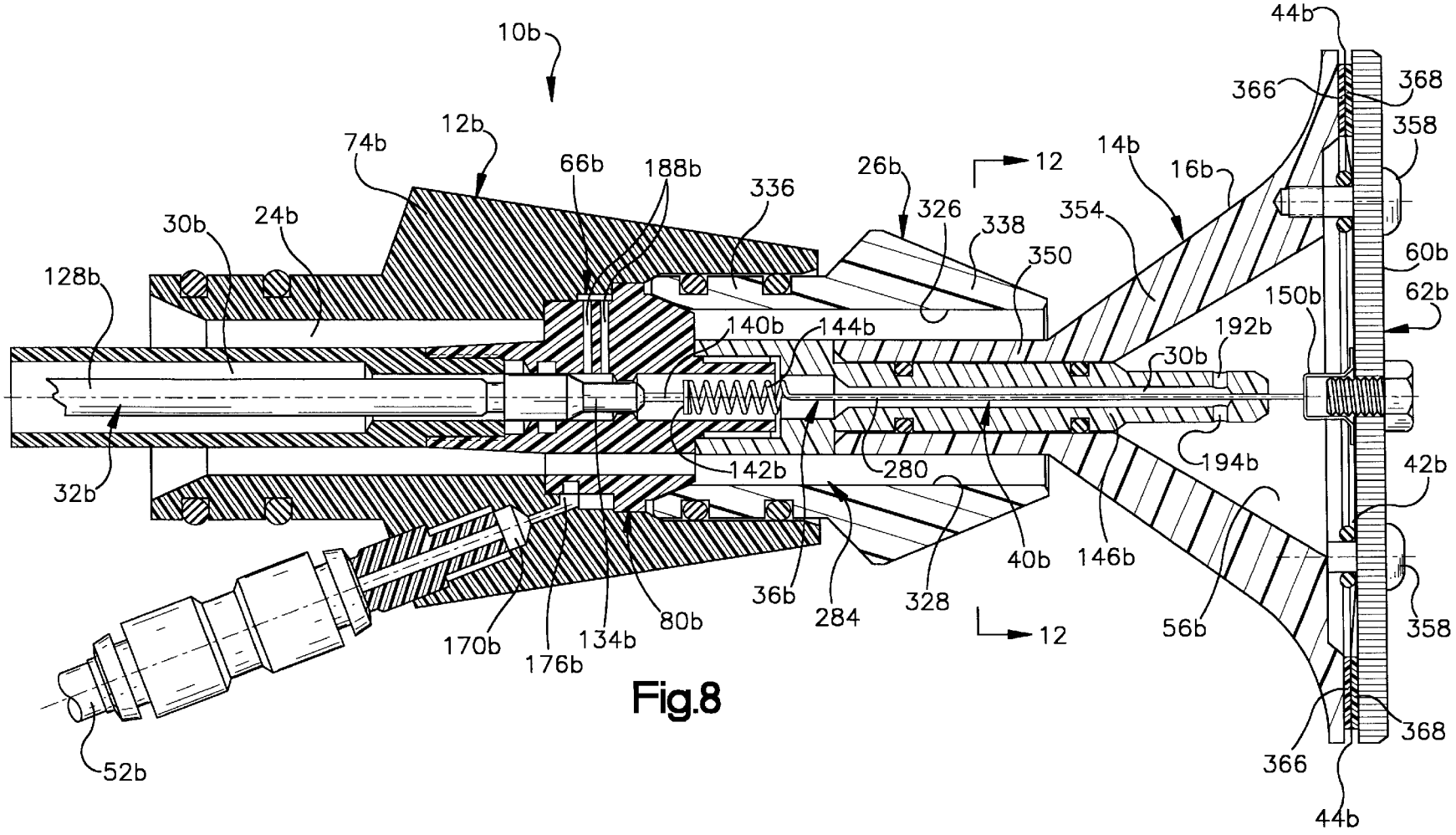
FIG. 8 is a fragmentary sectional view of an embodiment of the apparatus of FIG. 1 which is constructed in accordance with the present invention and is effective to apply particles to a workpiece in a relatively large pattern.
Figure 9:
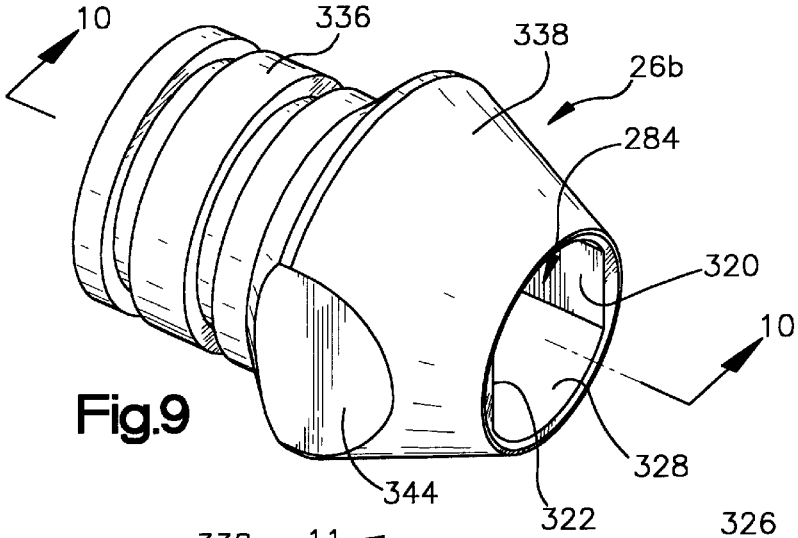
FIG. 9 is a pictorial illustration of a nozzle utilized in the apparatus of FIG. 8.

In the embodiment of the invention illustrated in FIGS. 8–14, the size of the pattern of particles applied to a workpiece is increased along one axis of the pattern. This enables a relatively wide strip of particles to be applied to a workpiece upon relative movement between the workpiece and the spray apparatus. However, it should be understood that the embodiment of the invention illustrated in FIGS. 8–14 may be utilized in situations other than situations which it is desired to apply a wide strip of particles to a workpiece. Since the embodiment of the invention illustrated in FIGS. 8–1 is generally similar to the embodiment of the invention illustrated in FIGS. 1–7, similar numerals will be utilized to designate similar components, the suffix letter "b" being associated with the numerals of FIGS. 8–14 to avoid confusion.

In the embodiment of the invention illustrated in FIGS. 8–14, an apparatus or spray gun 10*b* (FIG. 8) is used to direct a flow of air with particles entrained therein toward a workpiece. The spray gun 10*b* includes a housing assembly 12*b*. A conical deflector 14*b* is connected with the housing assembly 12*b*. A flow of air with particles entrained therein flows along a generally conical outer side surface 16*b* of the deflector 14*b* to expand the flow of air with particles entrained therein. Although only a portion of the spray gun 10*b* is illustrated in FIG. 8, it should be understood that the remainder of the spray gun 10*b* has the same construction as the spray gun 10 of FIG. 1.

The flow of air with particles of powder entrained therein is conducted to the housing assembly 12*b* (FIG. 8) through a delivery conduit (not shown). The flow of air with particles of powder entrained therein is conducted from the delivery conduit to an outer central passage 24*b* disposed in the housing assembly 12*b*. The outer central passage 24*b* extends through a nozzle 26*b* constructed in accordance with one of the features of the invention. The nozzle 26*b* directs the flow of air with powder particles entrained therein toward the deflector 14*b*.

An inner central passage 30*b* in the housing 12*b* is coaxial with and is circumscribed by the outer central passage 24*b*. The inner central passage 30*b* extends from the housing assembly 12*b* through the nozzle 26*b* into the deflector 14*b*. An electrical apparatus 32*b* includes a voltage multiplier (not shown) and an electrode arrangement 36*b*. The voltage multiplier supplies a relatively high voltage, about 100,000 volts, to the electrode arrangement 36*b*.

The electrode arrangement 36*b* (FIG. 8) electrostatically charges particles of powder entrained in the flow of air discharged from the spray gun 10*b* toward the workpiece. The electrode arrangement 36*b* includes an electrode rod 40*b* which extends into a portion of the inner central passage 30*b* located in the deflector 14*b*. The electrode arrangement 36*b* also includes a circular electrode sheet 42*b* which is located in an axially outer end portion of the deflector 14*b*.

A continuous annular peripheral edge portion 44*b* of the electrode sheet 42*b* is disposed in an axially and radially outer end portion of the deflector 14*b*. The peripheral edge portion 44*b* of the electrode sheet 42*b* is exposed to the flow of air with particles of powder entrained therein. The relatively high voltage from the voltage multiplier is conducted to the electrode sheet 42*b* through the electrode rod 40*b*. This voltage is effective to electrostatically charge the particles of powder entrained in the flow of air as the particles of powder move past the outer end portion of the deflector 14*b*. In the embodiment of the invention illustrated in FIG. 8, the electrode sheet 42*b* has a circular configuration with a continuous edge portion rather than the segmented configuration of the electrode sheet 42 of FIG. 6. However, the electrode sheet 42*b* could have any desired configuration.

At least a portion of the electrode arrangement 36*b* is exposed to a flow of fluid (air) to remove any contaminants which may accumulate around the electrode arrangement. The flow of air is conducted from a regulated compressed air supply (not shown) through a fluid supply conduit 52*b* to the inner central passage 30*b*. The flow of air is conducted along the electrical apparatus, in the part of the inner central passage 30*b* which is forward of a tip element 134*b*, to a generally conical chamber 56*b* in the deflector 14*b* through passages 192*b* and 194*b* in a generally cylindrical support 146*b*. There is also a restricted flow of air from the passage 30*b* into the chamber 56*b* along a portion of the electrode rod 40*b* which extends through an end of the cylindrical support 146*b*.

The electrode rod 40*b* (FIG. 8) and other components of the electrical apparatus 32*b* are disposed in the inner central passage 30*b*. Therefore, the flow of air in the inner central passage 30*b* forward of the tip element 134*b* washes away or removes any contaminants which may accumulate adjacent to the electrode rod 40*b* and/or other components of the electrical apparatus 32*b* which are forward of the tip element 134*b*. The contaminants may be the result of an interaction between components of the housing assembly 12*b* and/or deflector 14*b* and the electrical apparatus 32*b* due to the high voltage in the electrical apparatus.

During operation of the spray gun 10*b*, powder particles may tend to accumulate on a front surface 60*b* of the deflector 14*b*. The accumulation of particles on the circular front surface 60*b* of the deflector 14*b* is retarded by air flow from the chamber 56*b* in the deflector. The air flows from the chamber 56*b* through the porous electrode sheet 42*b* and through a porous member 62*b* on which the front surface 60*b* of the deflector 14*b* is disposed. The porous member 62*b* forms a circular front wall of the deflector 14*b*.

During operation of the spray gun 10*b*, the high voltage conducted through the electrical apparatus 32*b* may cause an arc to form in a passage system 66*b* (FIG. 8) which connects the air supply conduit 52*b* with the inner central passage 30*b*. The passage system 66*b* to the electrical apparatus 32*b* within the inner central passage 30*b* is made relatively long and circuitous to prevent the formation of an arc in the passage system 66*b*. Thus, the passage system 66*b* extends at least half way around the outer central passage 24*b* before being connected with the inner central passage 32*b*. The resulting substantial length and changes in direction of the passage system 66*b* prevents the formation of an arc to external ground since the arc would have to travel through the passage system 66*b* from the electrical apparatus 32*b* to a ground outside of the housing assembly 12*b*.

The passage system 66*b* includes an annular intermediate passage 176*b* which is connected with an air inlet passage 170*b*. The annular intermediate passage 176*b* extends around and is coaxial with the outer central passage 24*b* and the inner central passage 30*b*. A plurality of radially extending connector passages 188*b* are formed in a strut in a one-piece support structure or spider 80*b*. The spider 80*b* of FIG. 8 has the same general construction as the spider 80 of FIGS. 3 and 4. The passages 188*b* in the spider 80*b* of FIG. 8 are connected with the annular intermediate passage 176*b* at a location which is diametrically opposite from the location where the inlet passage 170*b* is connected with the annular intermediate passage. Therefore, air must flow half way around the spider 80*b* before entering the passages 188*b*.

Once air has been conducted from the fluid supply conduit 52*b* through the passage system 66*b* to the inner central passage 30*b*, the fluid flows along the components of the electrical apparatus 32*b*. Thus, the air flows axially along the exterior of the tip 134*b* and along a coil spring 144*b* which engages a contact washer 142*b*. The contact washer 142*b* is electrically connected with a resistor stack 128*b* by a pin 140*b*. The contact washer 142*b* makes solid electrical contact with the spring 144*b*. The spring 144*b* and straight cylindrical rod section 280 are integrally formed by one piece of stainless steel. Alternatively, the pin 140*b* could directly contact spring 144*b*.

Third Embodiment—Nozzle

Figure 12:
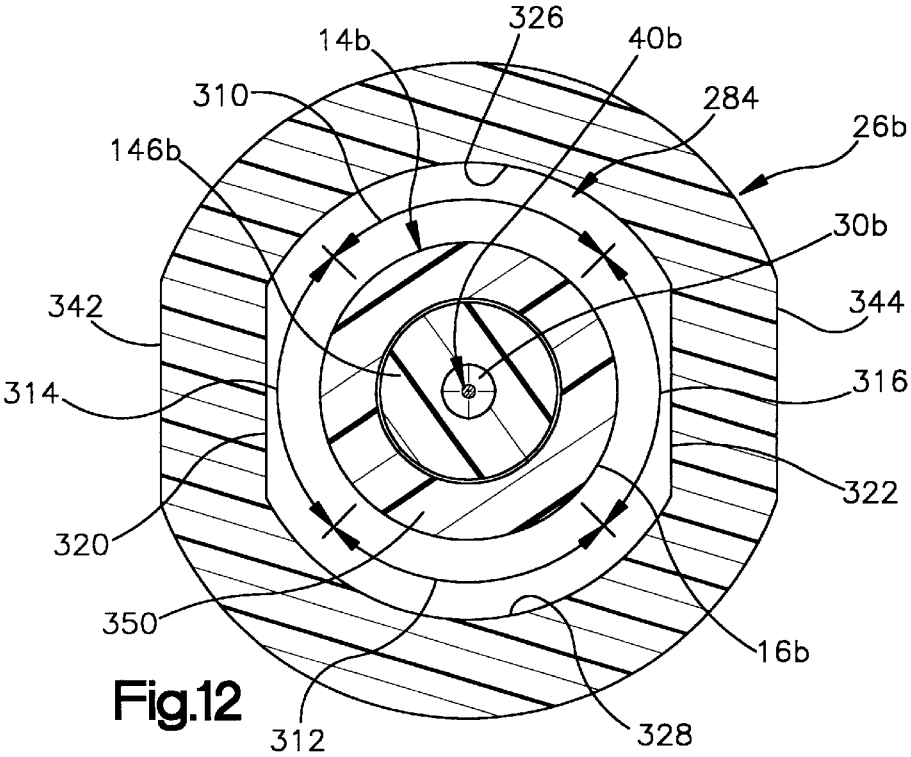
FIG. 12 is an enlarged sectional view, taken generally along the line 12—12 of FIG. 8, illustrating the relationship of a noncircular passage through the nozzle to a circular portion of a deflector.

In accordance with a feature of the embodiment of the invention illustrated in FIGS. 8–14, a central passage 284 (FIGS. 8–12) through the nozzle 26*b* has a noncircular cross sectional configuration in a plane which extends perpendicular to a longitudinal central axis of the passage. Thus, the passage 284 has a flat sided oval cross sectional configuration as shown in FIG. 12. However, it should be understood that the passage 284 could have a different cross sectional configuration if desired. For example, the passage 284 could have an elliptical cross sectional configuration or polygonal cross sectional configuration if desired.

The noncircular cross sectional configuration of the passage 284 enables the passage to direct particles of powder toward vertically opposite upper and lower portions of the conical outer side surface 16*b* (FIG. 8) of the deflector 14*b* at a greater volumetric flow rate than against horizontally opposite side portions of the outer side surface of the deflector. By concentrating the flow of particles of powder against upper and lower portions of the outer side surface 16*b* of the deflector 14*b*, an elongated or generally elliptical pattern 288 (FIG. 13) of powder particles is applied to a workpiece 289.

The pattern 288 has a central opening 290 (FIG. 13) with a generally circular configuration. The opening 290 is axially aligned with the circular front surface 60*b* (FIG. 8) of the deflector 14*b*. Although the opening 290 (FIG. 13) in the pattern 288 is substantially free of powder particles, there may be some powder particles on the portion of the workpiece 289 at the opening 290. The pattern 288 has a generally oval body portion 292 which is aligned with the flat sided oval cross sectional configuration of the passage 284 in the nozzle 26*b*. The body portion 292 of the pattern 288 extends outward from the opening 290 and forms a continuous coating of powder particles on a surface of the workpiece 289.

Upon relative movement between the workpiece 289 and the spray gun 10*b*, a continuous strip of powder particles is applied to the workpiece. For example, if the workpiece 289 is moved in the direction of the arrow 296 in FIG. 13, a continuous strip of powder will be deposited on the surface of the workpiece by the stationary spray gun 10*b*. Of course, the spray gun 10*b* could be moved relative to the workpiece 289 rather than moving the workpiece relative to the spray gun.

Since the pattern 288 has a greater extent along a major central axis 298 than along a minor central axis 300, the strip of powder which is formed on the workpiece during movement of the workpiece relative to the spray gun 10 will be relatively wide. Although the pattern 288 of powder has been shown in FIG. 13 as having its major central axis 298 in a vertical orientation, the major central axis of the pattern could be in any desired orientation. For example, the major central axis 298 of the pattern 288 could be disposed in a horizontal orientation and the pattern applied to a stationary workpiece by moving the spray gun 10*b* along a vertical path.

The oval or oblong configuration of the pattern 288 results, in part at least, from the noncircular cross sectional configuration of the passage 284 (FIG. 12) through the nozzle 26*b*. The portion of the outer central passage 24*b* upstream from the nozzle 26*b* (FIG. 8) has a circular cross sectional configuration. This results in the flow of air with powder entrained therein having a generally cylindrical configuration when the flow of air with powder particles entrained therein enters the nozzle 26*b*. The cylindrical stream of air with powder entrained therein has a substantially uniform volumetric flow rate of powder across the circular cross section of the stream.

The noncircular cross sectional configuration of the passage 284 in the nozzle 26*b* alters the configuration of the flow of air with particles of powder entrained therein. Thus, a relatively large percentage of the particles of powder are concentrated in a relatively large upper portion 310 (FIG. 12) of the passage 284 and in a relatively large lower portion 312 of the passage. A relatively small percentage of the particles of powder are concentrated in the relatively small side portion 314 of the passage 284 and a relatively small opposite side portion 316 of the passage. This is because the upper and lower portions 310 and 312 of the passage 284 are larger than the side portions 314 and 316 of the passage. Of course, the smaller the cross sectional area of the side portions 314 and 316 of the passage 284 relative to the upper and lower portions 310 and 312 of the passage, the greater will be the concentration of the powder particles in the upper and lower portions 310 and 312 of the passage 284.

Figure 10:
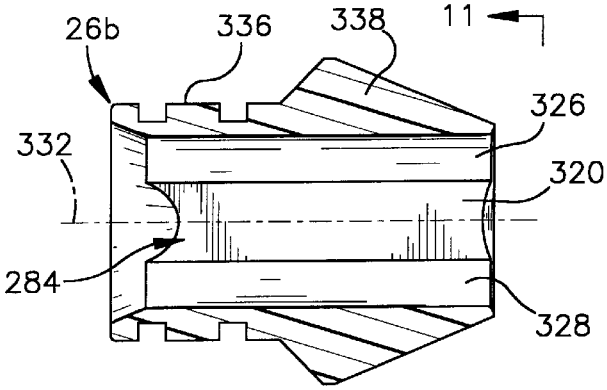
FIG. 10 is a sectional view, taken generally along the line 10—10 of FIG. 9, further illustrating the construction of the nozzle.
Figure 11:
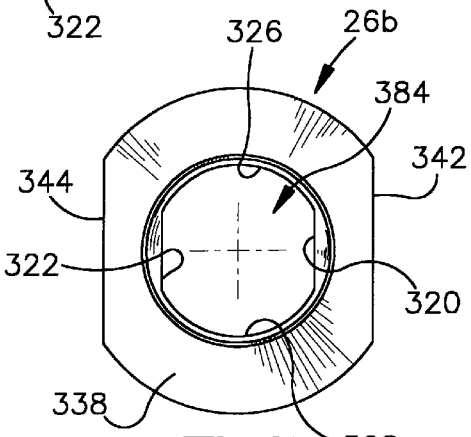
FIG. 11 is an end view, taken generally along the line 11—11 of FIG. 10, further illustrating the construction of the nozzle.

The passage 284 is partially defined by a pair of flat parallel inner side surfaces 320 and 322 which extend axially through a major portion of the length of the nozzle 26*b* (FIG. 10). An upper (as viewed in FIG. 12) arcuate inner side surface 326 of the nozzle 26*b* extends between the flat side surfaces 320 and 322. A lower arcuate inner side surface 328 also extends between the flat side surfaces 320 and 322. The upper and lower arcuate side surfaces 326 and 328 are formed as portions of a circle having a center of curvature on a longitudinal central axis 332 (FIG. 10) of the nozzle 26*b*. As was previously mentioned, the passage 284 could have a cross sectional configuration which is different than the specific cross sectional configuration illustrated in FIG. 12.

The nozzle 26*b* has a generally cylindrical mounting section 336 (FIG. 9) and a generally conical body section 338. The mounting section 336 is telescopically received in a nozzle extension 74*b* (FIG. 8) which forms part of the housing assembly 12*b*. The deflector 14*b* extends into the body section 338 of the nozzle 26*b*. The deflector 14*b* is disposed in a coaxial relationship with the nozzle 26*b*.

A pair of flat parallel outer side surfaces 342 and 344 (FIGS. 9, 11 and 12) are disposed on the body section 338 of the nozzle 26*b*. The flat outer side surfaces 342 and 344 extend parallel to the flat inner side surfaces 320 and 322. The flat outer side surfaces 342 and 344 indicate to an operator of the spray gun 10*b* the orientation of the nozzle 26*b* about the longitudinal central axis 332 (FIG. 10) of the nozzle. The nozzle 26*b* can be rotated about its longitudinal central axis 332 to change the orientation of the pattern 288 (FIG. 13) relative to the workpiece.

Third Embodiment—Deflector

The deflector 14*b* has a cylindrical stem portion 350 (FIGS. 8 and 12) which extends into the passage 284 in the nozzle 26*b*. The cylindrical stem portion 350 of the deflector 14*b* is disposed in a coaxial relationship with the nozzle 26*b*. Thus, a central axis of the stem portion 350 of the deflector 14*b* is coincident with the central axis 332 (FIG. 10) of the nozzle 26*b*. If desired, the stem portion 350 of the deflector 14*b* could be mounted with its central axis offset to one side of and parallel to the central axis 332 of the nozzle 26*b*.

In addition, the deflector 14*b* includes a conical main portion or section 354 (FIG. 8) which is integrally formed as one piece with the stem portion 350. The generally conical outer side surface 16*b* of the deflector 14*b* is disposed on the main portion 354 of the deflector. The main portion 354 and stem portion 350 of the deflector 14*b* are formed from a single piece of electrically insulating polymeric material. The conical main portion 354 of the deflector 14*b* has a circular cross sectional configuration throughout the axial extent of the main portion. The main portion 354 of the deflector 14*b* is disposed in coaxial relationship with the nozzle 26*b* and the passage 284 through the nozzle. However, if desired, the main portion 354 of the deflector 14*b* could have a central axis which is offset to one side of the central axis of the nozzle 26*b*. Of course, this would restrict the portion of the passage 284 through the nozzle 26*b* on the side toward which the deflector 14*b* is offset.

In accordance with one of the features of the invention, the circular porous member 62*b* is releasably connected with the main portion 354 of the deflector 14*b* by fasteners 358 formed of an electrically insulating material. In the illustrated embodiment of the invention, the fasteners 358 are screws formed of a polymeric material. Of course, other known types of fasteners could be utilized to releasably connect the porous member 62*b* with the main portion 354 of the deflector if desired. The releasable fasteners enable the porous member 62*b* and/or electrode sheet 42*b* to be disconnected from the main portion 354 of the deflector 14*b* for cleaning or other purposes.

The porous member 62*b* has the same construction and is formed of the same electrically insulating material as the porous member 62 of the embodiment of the invention illustrated in FIGS. 1–7. The porous circular member 62*b* is axially aligned with the nozzle 26*b*. However, if the axis of the deflector 14*b* is offset to one side of the nozzle 26*b*, the porous member 62*b* would also be axially offset relative to the nozzle.

In the embodiment of the deflector 14*b* illustrated in FIG. 8, the electrode sheet 42*b* has a circular configuration and is formed of a porous woven stainless steel fabric. Of course, a different electrically conductive, semiconductive, or even resistive material could be utilized to form the circular electrode sheet 42*b* if desired. Rather than being formed of a woven metal fabric or screen, the electrode sheet 42*b* could be formed by an array of wires.

The cylindrical rod portion 280 of the electrode 40*b* is connected with the electrode sheet 42*b* through a steel cup-shaped eyelet 150*b*. The cup-shaped eyelet 150*b* (FIG. 8) abuts a central portion of the circular electrode sheet 42*b*. The electrode 40*b* has a longitudinal central axis which extends perpendicular to the electrode sheet 42*b*. The axially outer end of the cylindrical rod section 280 of the electrode 40*b* is pressed against the eyelet 150*b* by the left (as viewed in FIG. 8) end portion of the electrode 40*b*.

A pair of annular polymeric seal rings or members 366 and 368 are disposed on opposite sides of the electrode sheet 42*b* in engagement with the porous member 62*b* and the main portion 354 of the deflector 14*b*. The seal rings or members 366 and 368 are electrically insulating and are effective to almost completely block the flow of fluid from the chamber 56*b* along the electrode sheet 42*b*. Although the rear plate 200 (FIG. 4) has been omitted from the embodiment of the deflector illustrated in FIG. 8, it is contemplated that a porous rear plate, corresponding to the rear plate 200 of FIG. 4, could be utilized in the deflector 14*b* if desired.

The annular peripheral portion of the circular electrode sheet or screen 42*b* is disposed between and extends radially outward from the annular seal members 366 and 368 (FIG. 8). This results in the circular periphery of the electrode sheet 42*b* being exposed to the flow of air with particles of powder entrained therein. Therefore, electrostatic charging of the air entrained particles of powder by electrical energy conducted through the electrode sheet 42*b* is facilitated.

The annular seal members 366 and 368 are disposed in engagement with opposite sides of the electrode sheet 42*b*. The seal member 366 is disposed in engagement with the conical main portion 354 of the deflector 14*b* and an inner side of the electrode sheet 42*b*. The seal member 368 is disposed in engagement with an inner side of the porous member 62*b* and an outer side of the electrode sheet 42*b*. Although a pair of annular seal members 366 and 368 are utilized in the illustrated embodiment of the invention, only a single seal member could be utilized if desired. Thus, the seal member 366 could press the outer side of the circular electrode sheet 42*b* directly against the flat circular inner side surface of the porous member 62*b* if desired.

In the illustrated embodiment of the invention in which two seal members 366 and 368 are used, the annular peripheral portion of the electrode sheet 42*b* is held between the seal members. Radially inward from the seal members 366 and 368, the electrode sheet 42*b* bends outward toward the porous member 62*b*. This results in an outer side of the electrode sheet 42*b* being disposed in flat abutting engagement with an inner side of the porous member 62*b* radially inward of the outer seal member 368. The cup-shaped eyelet 150*b* (FIG. 8) presses a central portion of the circular electrode sheet 42*b* firmly against the flat inner side surface of the porous member 62*b*.

The fasteners 358 extend through the porous member 62*b* and electrode sheet 42*b* to engage the main portion 354 of the deflector 14*b*. The fasteners 358 are disposed radially inward of the annular seal members 366 and 368 and are effective to squeeze the seal members between the porous member 62*b* and main portion 454 of the deflector 14*b*. Suitable O-rings cooperate with the fasteners 358 to hold the electrode sheet 42*b* in place on the porous member 62*b* upon disconnection of the fasteners and porous member from the main portion 354 of the deflector 14*b*. If desired, the fasteners 358 could extend through the seal members 366 and 368.

Third Embodiment—Operation

When the spray gun 10*b* is to be operated, the spray gun may be mounted on a stationary fixture or other support structure. The nozzle 26*b* is for some applications oriented with the flat inner side surfaces 320 and 322 in parallel vertical planes. A delivery conduit is connected with the housing assembly 12*b* and a source of air with particles of powder entrained therein. The conduit 52*b* is connected with a source of air under pressure.

Upon actuation of a suitable gun control module, air with powder entrained therein is conducted through the delivery conduit to the housing assembly 12*b* of the spray gun 10*b*. A stream of air with powder entrained therein is then conducted along the passage 24*b* toward the nozzle 26*b*. Before the stream of air with power entrained therein enters the nozzle 26*b*, the stream has a circular cross sectional configuration, as viewed in a plane extending perpendicular to a longitudinal central axis of the stream.

In accordance with a feature of this embodiment of the invention, the passage 284 in the nozzle 26*b* shapes the stream of air with particles of powder entrained therein to a noncircular cross sectional configuration to enable the deflector 14*b* to form the noncircular pattern 288. The flat inner side surfaces 320 and 322 of the passage 284 are disposed closer to the stem portion 350 of the deflector 14*b* than the arcuate upper and lower side surfaces 326 and 328 of the passage 284. This results in the flow of particles of powder through the side portions 314 and 316 (FIG. 12) of the passage 284 being restricted relative to the flow of particles of powder through the upper and lower portions 310 and 312 of the passage 284. Therefore, there is a greater volumetric flow rate of air and particles of powder through the upper and lower portions 310 and 312 of the passage 284 than through the opposite side portions 314 and 316 of the passage.

This results in an uneven distribution of the flow of air with particles of powder entrained therein along the outer side surface 16*b* of the deflector 14*b*. There is a relatively large volumetric rate of flow of particles of powder along the portions of the outer side surface 16*b* of the deflector 14*b* which are axially aligned with the upper and lower portions 310 and 312 of the passage 284. There is a relatively small rate of volumetric flow of particles of powder along the portions of the outer side surface 16*b* of the deflector 14*b* which are axially aligned with the side portions 314 and 316 of the passage 284. This results from the noncircular cross sectional configuration of the passage 284 relative to the circular cross sectional configuration of the outer side surface 16*b* of the deflector 14*b*.

Since there is a larger volumetric flow rate of particles of powder through the upper and lower portions 310 and 312 of the nozzle 26*b*, there will be a larger volumetric flow rate of powder along the upper and lower portions of the outer side surface 16*b* of the deflector 14*b*. This results in the application of the pattern 288 (FIG. 13) to the workpiece 289 with a relatively large portion of the pattern disposed along the vertical major central axis 298 of the pattern. A circular central opening 290 in the pattern is axially aligned with the center of the deflector 14*b*.

The major central axis 298 of the pattern 288 is parallel to the flat inner side surfaces 320 and 322 of the nozzle 26*b*. The central axis 298 of the pattern 288 extends through the coincident longitudinal central axes of the nozzle 26*b* and deflector 14*b*. The orientation of the central axis 298 of the pattern 288 relative to the workpiece 289 can be changed by manually rotating the nozzle 26*b* about its central axis 332 relative to the nozzle extension 74*b* of the housing assembly 12*b*.

Figure 13:
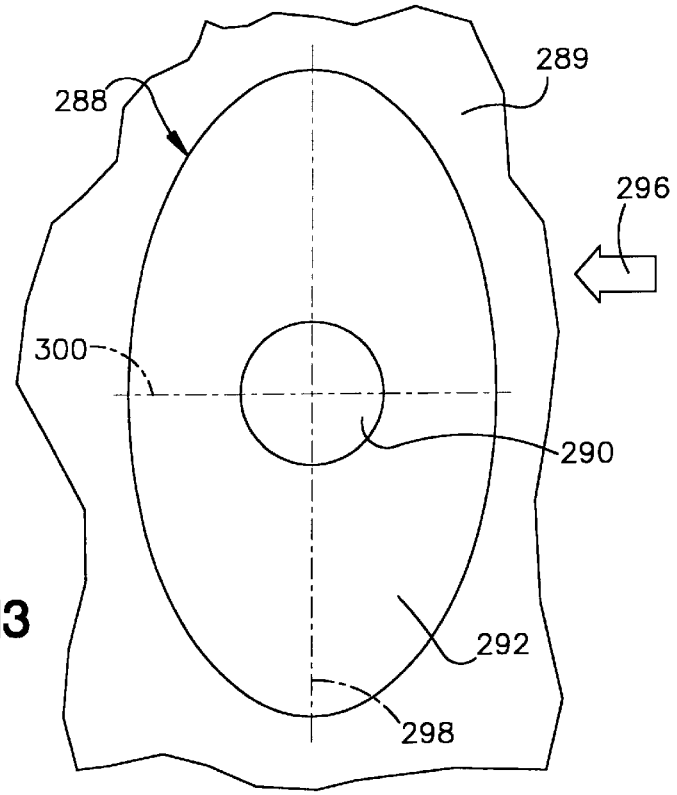
FIG. 13 is a schematicized illustration of a pattern of particles which is applied to a workpiece using the apparatus of FIG. 8.

As a flow of air with particles of powder entrained therein is directed toward the workpiece 289 from the deflector 14*b* of the spray gun 10*b*, the workpiece is moved in the horizontal direction of the arrow 296 in FIG. 13. As this occurs, a continuous strip of powder is applied to the workpiece. The continuous strip of powder will have a transverse cross sectional thickness similar to the pattern thickness illustrated schematically by a curve 400 in FIG. 14. The curve 400 is a cross sectional view of the continuous strip of powder. The curve 400 is a view taken along the major axis 298 in FIG. 13.

Figure 14:
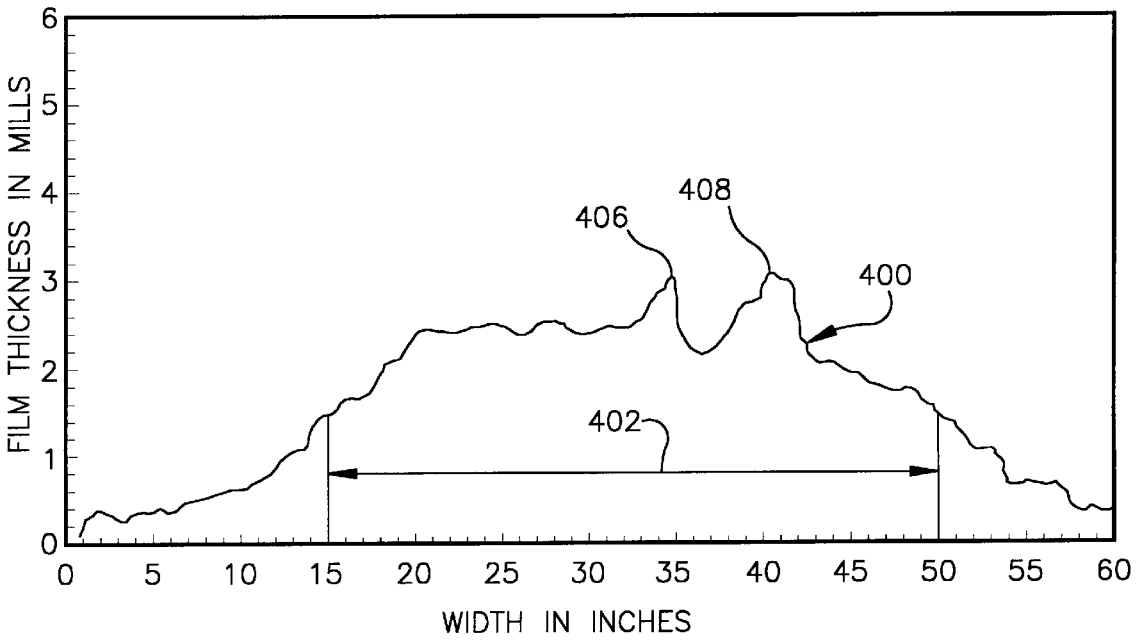
FIG. 14 is a graph depicting the distribution of particles across a strip applied to a workpiece by effecting relative movement between the workpiece and the apparatus of FIG. 8.

The curve 400 schematically represents the thickness of the strip of powder applied to the workpiece as the workpiece moves in the direction of the arrow 296 of FIG. 13. The vertical (as viewed in FIG. 13) width of the strip of powder applied to the workpiece is approximately 35 inches. The portion of the strip indicated by the arrow 402 in FIG. 14 has a thickness which is greater than-one half of the maximum thickness of the strip. Thus, the maximum thickness of the strip, as indicated at 406 and 408 in FIG. 14 is approximately 3 mils. The 35 inch width of the strip, indicated by the arrow 402, has a thickness of approximately 1.5 mils or more. The portion of the strip which has a thickness of less than 1.5 mils will be overlapped by a next adjacent strip. It should be noted that the thickness of the strip is relatively even across the 35 inch width of the strip so that a smooth coating of powder is applied to the workpiece with a minimum of waste.

From the above description of the invention, those skilled in the art will perceive improvements, changes and modifications. Such improvements, changes and modifications within the skill of the art are intended to be covered by the appended claims.

Having described the invention, the following is claimed:

1. A method comprising the steps of directing a flow of air with particles entrained therein toward a workpiece, deflecting at least a portion of the flow of air with particles entrained therein with a deflector, said step of deflecting at least a portion of the flow of air with particles entrained therein with a deflector includes conducting a flow of air with particles entrained therein along a first surface area on the deflector at a first volumetric flow rate of particles, and simultaneously therewith conducting a flow of air with particles entrained therein along a second surface area on the deflector at a second volumetric flow rate of particles, said second volumetric flow rate of particles being greater than said first volumetric flow rate of particles.

2. A method as set forth in claim 1 further including the step of depositing the particles on a surface area of a workpiece in a pattern having a substantially open central portion, said step of depositing the particles on a surface area of the workpiece includes depositing particles conducted along the first surface area on the deflector on a first surface area on the workpiece with a particle density sufficient to cover the first surface area on the workpiece, and depositing particles conducted along the second surface area on the deflector on a second surface area on the workpiece with a particle density sufficient to cover the second surface area on the workpiece, the second surface area on the workpiece extends outward from the open central portion of the pattern for a distance which is greater than the distance which the first surface area on the workpieces extends outward from the open central portion of the pattern.

3. A method as set forth in claim 2 further including the step of electrostatically charging particles conducted along first and second surface areas on the deflector with an electrode which is at least partially disposed in the deflector, said step of electrostatically charging particles being performed prior to performance of said step of depositing the particles on a surface of a workpiece.

4. A method as set forth in claim 3 wherein the electrode is a porous sheet, said method further including conducting a flow of fluid through the porous electrode sheet and thereafter through a porous surface area on the deflector.

5. A method as set forth in claim 3 further including the step of providing relative movement between the workpiece and the deflector to effect a depositing of the particles on the workpiece in a strip.

6. A method comprising the steps of directing a flow of air with particles entrained therein toward a workpiece, deflecting at least a portion of the flow of air with particles entrained therein with a deflector, said step of deflecting at least a portion of the flow of air with particles entrained therein with a deflector includes conducting a flow of air with particles entrained therein along a first surface area on the deflector at a first volumetric flow rate of particles, simultaneously therewith conducting a flow of air with particles entrained therein along a second surface area on the deflector at the first volumetric flow rate of particles, simultaneously therewith conducting a flow of air with particles entrained therein along a third surface area on the deflector at a second volumetric flow rate of particles, said second volumetric flow rate of particles being greater than said first volumetric flow rate of particles, and simultaneously therewith conducting a flow of air with particles entrained therein along a fourth surface area on the deflector at the second volumetric flow rate of particles.

7. A method as set forth in claim 6 further including the step of depositing the particles on a surface area of a workpiece in a pattern having a substantially open central portion, said step of depositing the particles on a surface area of the workpiece includes depositing particles conducted along the first surface area on the deflector on a first surface area on the workpiece with a particle density sufficient to cover the first surface area on the workpiece, depositing particles conducted along the second surface area on the deflector on a second surface area on the workpiece with a particle density sufficient to cover the second surface area on the workpiece, the first and second surface areas on the workpiece extend outward from the open central portion of the pattern for substantially equal distances, depositing particles conducted along the third surface area on the deflector on a third surface area on the workpiece with a particle density sufficient to cover the third surface area on the workpiece, and depositing particles conducted along the fourth surface area on the deflector on a fourth surface area on the workpiece with a particle density sufficient to cover the fourth surface area on the workpiece, the third and fourth surface areas on the workpiece extend outward from the open central portion of the pattern for substantially equal distances which are greater than the distance which the first and second surface areas on the workpieces extend outward from the open central portion of the pattern.

8. A method as set forth in claim 6 further including the step of electrostatically charging particles conducted along first, second, third and fourth surface areas on the deflector with an electrode which is at least partially disposed in the deflector.

9. A method as set forth in claim 8 wherein the electrode is a porous sheet, said method further including conducting a flow of fluid through the porous electrode sheet and thereafter through a porous surface area on the deflector.

10. A method as set forth in claim 6 wherein the first and second surface areas on the deflector are spaced apart from each other and are disposed between the third and fourth surface areas on the deflector.

11. An apparatus for use in directing a flow of air with particles entrained therein toward a workpiece, said apparatus comprising a housing, a nozzle connected with said housing, said nozzle having a passage through which the flow of air with particles entrained therein is conducted, said passage having a noncircular cross sectional configuration in a plane perpendicular to a longitudinal axis of said passage, and a deflector connected with said housing and disposed in a coaxial relationship with said nozzle, said deflector having an outer side surface which is engaged by the flow of air with particles entrained therein, said outer side surface of said deflector having a circular cross sectional configuration in a plane perpendicular to the longitudinal central axis of said passage, said nozzle includes a pair of parallel inner side surfaces which at least partially define said passage through which the flow of air with particles entrained therein is conducted.

12. An apparatus as set forth in claim 11 wherein said nozzle includes a pair of arcuate inner side surfaces which cooperate with said pair of parallel inner side surfaces to further define said passage through which the flow of air with particles entrained therein is conducted.

13. An apparatus as set forth in claim 12 wherein the distance between said pair of parallel inner side surfaces as measured along an axis extending perpendicular to said parallel inner side surfaces is less than the distance between said pair of arcuate inner side surfaces as measured along an axis extending through the longitudinal central axis of said passage in a direction parallel to said parallel inner side surfaces.

14. An apparatus as set forth in claim 11 wherein said outer side surface of said deflector has first and second diametrically opposite surface areas along which a flow of air with particles entrained therein is conducted at a first volumetric flow rate of particles and third and fourth diametrically opposite surface areas along which a flow of air with particles entrained therein is conducted at a second volumetric flow rate of particles, said first and second diametrically opposite surface areas being aligned with said parallel inner side surfaces of said nozzle, said first volumetric flow rate of particles being less than said second volumetric flow rate of particles.

15. An apparatus as set forth in claim 11 wherein said nozzle includes a pair of nonparallel inner side surfaces which cooperate with said pair of parallel inner side surfaces to further define said passage through which the flow of air with particles entrained therein is conducted.

16. An apparatus as set forth in claim 15 wherein at least portions of said pair of parallel inner side surfaces are closer to said outer side surface of said deflector than are said nonparallel inner side surfaces of said nozzle.

17. An apparatus as set forth in claim 11 wherein said deflector flares radially and axially outward in the direction of flow of air with particles entrained therein, said deflector includes a porous member formed of an electrically insulating material, a porous electrode sheet which is formed of an electrically conductive material to conduct electrical energy to electrostatically charge particles entrained in the flow of air, said porous electrode sheet being disposed in said deflector, said porous electrode sheet having a peripheral portion which is exposed to the flow of air with particles entrained therein at a location adjacent to an axially outer end portion of said deflector, and a conduit connected with a source of fluid pressure to conduct fluid which flows from said source of fluid pressure through said porous electrode sheet and then flows through said porous member.

18. An apparatus as set forth in claim 11 wherein said housing at least partially defines a passage which extends from said housing to said passage in said nozzle and through which a flow of air with particles entrained therein is conducted to said passage in said nozzle, said passage in said housing passage having a circular cross sectional configuration in a plane perpendicular to a longitudinal central axis of said passage in said housing.

19. An apparatus as set forth in claim 11 wherein said deflector includes a chamber and a porous member which forms an end surface of said deflector through which fluid is conducted from said chamber, said housing at least partially defining an inner central passage which extends from said housing through said nozzle to the chamber in said deflector and through which a flow of fluid is conducted, an electrode arrangement at least partially disposed in said inner central passage, at least a portion of said electrode arrangement being exposed to the flow of air with particles entrained therein to electrostatically charge particles entrained in the flow of air, said housing having surfaces which at least partially define an outer central passage which is disposed in a coaxial relationship with the inner central passage and which extends around and axially along at least a part of said inner central passage and through which the flow of air with particles entrained therein is conducted toward said nozzle, said housing including a strut which extends through a portion of the outer central passage and is exposed to the flow of air with particles entrained therein, said housing having surfaces which define a connector passage which communicates with the inner central passage through said strut, a conduit connected with said housing and with a fluid source from which fluid is conducted along a flow path which extends from the conduit to the connector passage, said conduit being connected with said housing at a first location offset outward from said outer central passage and disposed adjacent to a first side of said outer central passage, and an intermediate passage disposed in said housing and extending at least half way around said outer central passage, said intermediate passage extending at least half way around said outer central passage from a first location adjacent to a connection between said conduit and said housing to a second location adjacent to a side of said outer central passage spaced from said first location and adjacent to a connection between said intermediate passage and said connector passage to enable fluid to be conducted from said conduit through said intermediate passage and said connector passage to said inner central passage along a flow path which retards establishment of an electrical arc between said electrode arrangement and a location adjacent to the connection between said conduit and said housing.

20. An apparatus as set forth in claim 11 wherein said deflector includes a chamber and a porous member through which fluid is conducted from said chamber, an electrode arrangement connected with said deflector and exposed to the flow of air with powder entrained therein to electrostatically charge particles in the flow of air.

21. An apparatus as set forth in claim 11 wherein said nozzle is rotatable relative to said housing, said nozzle having an outer side surface area which extends parallel to said parallel inner side surfaces of said nozzle to indicate orientation of said parallel inner side surfaces of said nozzle relative to said housing.

22. An apparatus for use in directing a flow of air with particles entrained therein toward a workpiece, said apparatus comprising a housing, a nozzle connected with said housing, said nozzle having a passage through which the flow of air with particles entrained therein is conducted to a spray orifice, said passage having a noncircular cross sectional configuration in a plane perpendicular to a longitudinal axis of said passage, said noncircular cross section extending at least along a portion of the passage which terminates in said spray orifice, and a deflector connected with said housing and disposed in a coaxial relationship with said nozzle in front of said spray orifice, said deflector having an outer side surface which is engaged by the flow of air with particles entrained therein, said outer side surface of said deflector having a circular cross sectional configuration in a plane perpendicular to the longitudinal central axis of said passage.

23. An apparatus as set forth in claim 22 wherein said portion of the passage which terminates in said spray orifice has first and second side surface areas which are spaced a first distance from the longitudinal central axis of said nozzle and third and fourth side surface areas which are spaced a second distance from a longitudinal central axis of said nozzle, said second distance being smaller than said first distance.

24. An apparatus as set forth in claim 23 wherein said outer side surface of said deflector has first and second surface areas which are aligned with said first and second side surface areas of said nozzle and along which a flow of air with particles entrained therein is conducted at a first volumetric flow rate of particles and third and fourth surface areas which are aligned with said third and fourth side surface areas of said nozzle and along which a flow of air with particles entrained therein is conducted at a second volumetric flow rate of particles, said first volumetric flow rate of particles being greater than said second volumetric flow rate of particles.

25. An apparatus as set forth in claim 23 wherein said third and fourth side surface areas of said nozzle extend parallel to each other and are disposed along opposite sides of the spray orifice.

26. An apparatus as set forth in claim 22 wherein said noncircular cross sectional configuration of said passage extends between axially opposite ends of said nozzle.

27. An apparatus for use in directing a flow of air with particles entrained therein toward a workpiece, said apparatus comprising a nozzle having an opening through which the flow of air with particles entrained therein leaves said nozzle, said opening having a noncircular cross sectional configuration in a plane perpendicular to a longitudinal axis of said nozzle, and a deflector connected with said nozzle, said deflector having an outer side surface which is engaged by the flow of air with particles entrained therein, said outer side surface of said deflector having a cross sectional configuration in a plane perpendicular to a longitudinal central axis of said nozzle which is different than the noncircular cross sectional configuration of said openings, wherein said opening from said outer end portion of said nozzle has first and second side surface areas which are spaced a first distance from the longitudinal central axis of said nozzle and third and fourth side surface areas which are spaced a second distance from a longitudinal central axis of said nozzle, said second distance being smaller than said first distance.

28. An apparatus as set forth in claim 27 wherein said third and fourth side surface areas of said nozzle extend parallel to each other and are disposed along opposite sides of the opening from the outer end portion of said nozzle.

29. An apparatus as set forth in claim 27 wherein the noncircular cross sectional configuration of said passage extends between axially opposite ends of said nozzle.

30. An apparatus for use in directing a flow of air with particles entrained therein toward a workpiece, said apparatus comprising a housing having a passage through which the flow of air with particles entrained therein is conducted, said housing includes a structure having openings through which said passage extends, a portion of said passage downstream from said structure having a noncircular cross sectional configuration in a plane perpendicular to a longitudinal axis of said passage, and a deflector connected with and supported by said structure, said deflector having an outer side surface which is engaged by the flow of air with particles entrained therein, at least a portion of said outer side surface of said deflector having a circular cross sectional configuration in a plane perpendicular to the longitudinal central axis of said passage.

31. An apparatus as set forth in claim 30 wherein said outer side surface of said deflector has first and second diametrically opposite surface areas along which a flow of air with particles entrained therein is conducted from said portion of said passage downstream from said structure at a first volumetric flow rate of particles and third and fourth diametrically opposite surface areas along which a flow of air with particles entrained therein is conducted from said portion of said passage downstream from said structure at a second volumetric flow rate of particles, said first volumetric flow rate of particles being greater than said second volumetric flow rate of particles.

32. An apparatus as set forth in claim 30 wherein said portion of said passage downstream from said structure includes a pair of flat inner side surfaces which at least partially define the portion of the passage downstream from said structure and through which the flow of air with particles entrained therein is conducted.

33. An apparatus as set forth in claim 32 wherein said portion of said passage downstream from said structure includes a pair of arcuate inner side surfaces which cooperate with said pair of flat inner side surfaces to further define the portion of passage downstream from said structure and through which the flow of air with particles entrained therein is conducted.

34. An apparatus as set forth in claim 33 wherein the distance between said pair of flat inner side surfaces as measured along an axis extending perpendicular to said parallel inner side surfaces is less than the distance between said pair of arcuate inner side surfaces as measured along an axis extending through the longitudinal central axis of the portion of the passage downstream from said structure and in a direction parallel to said flat inner side surfaces.

35. An apparatus as set forth in claim 30 wherein said deflector flares radially and axially outward in the direction of flow of air with particles entrained therein, said deflector includes a porous member formed of an electrically insulating material, a porous electrode sheet which is formed of an electrically conductive material to conduct electrical energy to electrostatically charge particles entrained in the flow of air, said porous electrode sheet being disposed in said deflector, said porous electrode sheet having a peripheral portion which is exposed to the flow of air with particles entrained therein at a location adjacent to an axially outer end portion of said deflector, and a conduit connected with a source of fluid pressure to conduct fluid which flows from said source of fluid pressure through said porous electrode sheet and then flows through said porous member.

* * * * *